US007099611B2

(12) United States Patent
Aoki et al.

(10) Patent No.: US 7,099,611 B2
(45) Date of Patent: Aug. 29, 2006

(54) METHOD AND APPARATUS FOR IMAGE FORMING CAPABLE OF REDUCING MECHANICAL STRESSES TO DEVELOPERS DURING TRANSPORTATION FOR DEVELOPMENT

(75) Inventors: Katsuhiro Aoki, Kanagawa-ken (JP); Tsukuru Kai, Kanagawa-ken (JP); Hiroshi Ikeguchi, Saitama-ken (JP)

(73) Assignee: Ricoh Company, Ltd., Tokyo (JP)

( * ) Notice: Subject to any disclaimer, the term of this patent is extended or adjusted under 35 U.S.C. 154(b) by 112 days.

(21) Appl. No.: 10/772,371

(22) Filed: Feb. 6, 2004

(65) Prior Publication Data

US 2004/0223792 A1 Nov. 11, 2004

(30) Foreign Application Priority Data

Feb. 7, 2003 (JP) ..... 2003-031176
Feb. 25, 2003 (JP) ..... 2003-047384
Jan. 22, 2004 (JP) ..... 2004-013892

(51) Int. Cl.
*G03G 15/08* (2006.01)

(52) U.S. Cl. ..... 399/281

(58) Field of Classification Search ..... 399/111, 399/119, 252, 254, 279, 281, 289, 290, 291
See application file for complete search history.

(56) References Cited

U.S. PATENT DOCUMENTS 5,027,157 A * 6/1991 Hotomi et al. ..... 399/253
5,109,254 A 4/1992 Oka et al.
5,235,384 A 8/1993 Oka et al.
5,237,369 A 8/1993 Maruta et al.
5,255,059 A 10/1993 Kai et al.
5,293,198 A 3/1994 Sawayama et al.
5,323,214 A 6/1994 Kai
5,339,141 A 8/1994 Suzuki et al.
5,367,363 A 11/1994 Kai et al.
5,416,568 A 5/1995 Yoshiki et al.
5,424,809 A 6/1995 Sawayama et al.
5,424,814 A 6/1995 Suzuki et al.
5,442,430 A 8/1995 Ishii et al.
5,555,469 A 9/1996 Ishikawa et al.
5,565,973 A 10/1996 Fujishiro et al.
5,598,254 A 1/1997 Ikesue et al.
5,606,408 A 2/1997 Yano et al.
5,619,316 A 4/1997 Shoji et al.
5,638,159 A 6/1997 Kai et al.
5,655,193 A 8/1997 Fujishiro et al.
5,774,772 A 6/1998 Kai et al.
5,915,155 A 6/1999 Shoji et al.
RE36,301 E 9/1999 Kai et al.
5,987,298 A * 11/1999 Muramatsu et al. ..... 399/359
6,081,684 A 6/2000 Naganuma et al.
6,125,243 A 9/2000 Shoji et al.
6,163,669 A 12/2000 Aoki et al.

(Continued)

*Primary Examiner*—Hoan Tran
(74) *Attorney, Agent, or Firm*—Oblon, Spivak, McClelland, Maier & Neustadt, P.C.

(57) ABSTRACT

A toner contained in a hopper is fed to an electrostatic conveyance member by a supply roller. With an actuator of the electrostatic conveyance member functioning, the toner is conveyed while being electrically charged at the same time, and is then supplied to a development roller. A thin layer of toner is formed on the development roller under the effect of an electric field. Since the toner is formed and charged without a mechanical layer thickness controlling member such as a doctor blade, mechanical stress acting on the toner is reduced.

21 Claims, 14 Drawing Sheets

U.S. PATENT DOCUMENTS 6,295,437 B1 9/2001 Hodoshima et al.
6,366,751 B1 4/2002 Shakuto et al.
6,385,423 B1 5/2002 Kai
6,442,364 B1 8/2002 Kai et al.
6,449,452 B1 9/2002 Kai
6,456,806 B1 9/2002 Shoji et al.
6,463,244 B1 10/2002 Aoki et al.
6,505,014 B1 1/2003 Aoki et al.
6,507,722 B1 * 1/2003 Okamura et al. ..... 399/286
6,526,248 B1 2/2003 Aoki et al.
6,597,884 B1 7/2003 Miyaguchi et al.
6,597,885 B1 7/2003 Kai et al.
6,608,984 B1 8/2003 Matsumoto et al.
6,611,672 B1 8/2003 Aoki et al.
6,625,409 B1 9/2003 Shakuto et al.
6,654,579 B1 11/2003 Shakuto et al.
6,658,227 B1 12/2003 Oyama et al.
6,668,147 B1 12/2003 Ikeguchi
6,671,484 B1 12/2003 Miyoshi et al.
6,701,114 B1 3/2004 Sekine et al.
6,707,480 B1 3/2004 Ameyama et al.
6,708,014 B1 * 3/2004 Miyaguchi et al. ..... 399/266
6,721,516 B1 4/2004 Aoki et al.

* cited by examiner

METHOD AND APPARATUS FOR IMAGE FORMING CAPABLE OF REDUCING MECHANICAL STRESSES TO DEVELOPERS DURING TRANSPORTATION FOR DEVELOPMENT

BACKGROUND OF THE INVENTION

1. Field of the Invention

The present invention relates to a method and apparatus for image forming, and more particularly to a method and apparatus for image forming capable of effectively reducing mechanical stresses to developers during a transportation for a development to reproduce a superior quality image.

2. Description of the Related Art

A development device using a dry developer containing at least a toner is known in the field of an image forming apparatus using an electrophotographic technique, such as a copying apparatus, a facsimile machine, or a printer. In a known development device, a toner agitated in the development unit is deposited on the surface of a developer carrying member such as a development roller or a development sleeve, is formed in a uniform thin layer by a thin layer forming member such as a thin layer forming blade, and is conveyed to a development zone facing a photoconductive body as a latent image carrying member to develop a toner image from the latent image on the photoconductive body. Subsequent to development, the toner not transferred to the photoconductive body is returned into the development unit, agitated, charged and conveyed to the development zone again.

A development unit, disclosed in Japanese Unexamined Patent Application Publication No. 2002-148937, includes a development supply roller 120, as a developer carrying member, for supplying a toner to a development sleeve 110 as a developer carrying member, and a developer limiting roller 130 as a thin layer forming member (as shown in FIG. 2). In this arrangement, the developer is allowed to pass through between the development sleeve 110 and the limiting roller 130 to form the toner on the development sleeve 110 into a thin layer.

However, the toner in the development unit is subject to a large mechanical stress when the toner is formed into a thin layer by the thin layer forming member such as a thin layer forming blade or the developer limiting roller. Typically, an external additive is attached to the periphery of a matrix resin of toner to impart flowability to the toner. Under the presence of mechanical stress, the external additive is buried into the matrix resin. This reduces the flowability of the toner, thereby causing the toner to aggregate. The aggregated toner reduces the amount charge thereof, thereby leading to scumming, and toner supply failure. The toner tends to age rapidly, and maintaining image quality becomes difficult.

SUMMARY OF THE INVENTION

Accordingly, it is an object of the present invention to provide an image forming method and an image forming apparatus for reducing mechanical stress acting on a toner during a development process and allowing high-quality development to be performed for a long period of time.

To achieve the above object, an image forming method of the present invention in one aspect for forming an image by supplying a developer from a development unit to a latent image on a latent image carrying member for image development includes the steps of forming a thin layer of developer on a developer carrying member by generating an electric field in a developer supply zone between the developer carrying member of the development unit and a developer conveyance member, and conveying the thin layer of developer formed on the developer carrying member to a development zone facing the latent image carrying member.

Preferably, the developer image is developed from the latent image by putting the thin layer of developer formed on the developer carrying member into contact with the latent image carrying member to develop an image from the latent image.

Preferably, the developer image is developed from the latent image by generating an alternating electric field in the development zone to supply the thin layer of developer on the developer carrying member to the latent image carrying member in a non-contact manner.

The developer conveyance member may convey the developer using electrostatic effect to supply the developer to the developer carrying member.

The developer is preferably charged by a friction taking place between the developer conveyance member and the developer when the developer is conveyed by the developer conveyance member.

A protective layer made of a silicone-based resin is preferably disposed on the surface of the developer conveyance member.

A relationship of $|Vs|>|Vd|$ may hold where Vd represents a surface movement velocity of the developer carrying member, and Vs represents a developer conveyance velocity of the developer moving on the developer conveyance member.

An alternating field is preferably generated between the developer carrying member and the developer conveyance member, both of which are arranged to be out of contact from each other.

A powder pump may supply the developer to the developer conveyance member from a developer container.

A recovery unit for recovering the developer on the developer carrying member is preferably arranged downstream of the development zone and upstream of the developer supply zone along the surface movement direction of the developer carrying member.

A developer charge amount changing unit for changing the amount of charge of the developer on the developer carrying member is preferably arranged downstream of the development zone and upstream of the developer supply zone along the surface movement direction of the developer carrying member.

An electrically conductive member for applying a voltage to the developer on the developer carrying member is preferably arranged downstream of the development zone and upstream of the developer supply zone along the surface movement direction of the developer carrying member.

A toner having a spherical shape is preferably used as the developer.

The toner preferably has a sphericity of 0.96 or larger.

Preferably, a relationship of $P/\{(Vd/Vp)(Vs/Vd)\}<20\ \mu m$ preferably holds and a surface movement of the developer carrying member is aligned in the same direction as a surface movement of the latent image carrying member in the development zone, where P represents a pitch of electrodes in the developer conveyance member, Vs represents a developer conveyance velocity of the developer moved by the developer conveyance member, Vd represents a surface movement velocity of the developer carrying member, and Vp represents a surface movement velocity of the latent image carrying member.

The present invention in another aspect relates to an image forming apparatus for forming an image by supplying a developer from a development unit to a latent image on a latent image carrying member for image development. The image forming apparatus forms the image using one of the above-referenced image forming methods.

The image forming apparatus preferably includes a process cartridge having the development unit and the latent image carrying member integrated with the development unit in a unitary body, wherein the process cartridge is detachably mounted in the image forming apparatus.

The present invention in yet another aspect relates to a process cartridge and includes, at least, a latent image carrying member and a development unit, integrated with the latent image carrying member in a unitary body, for developing a developer image from a latent image on the latent image carrying member, wherein the process cartridge is detachably mounted into the image forming apparatus.

In accordance with preferred embodiments of the present invention, the electric field is generated between the developer carrying member of the development unit and the developer conveyance member. The electric field causes the charged developer to fly over a supply gap between the developer conveyance member and the developer carrying member, thereby forming a uniform, thin layer of toner on the developer carrying member. Mechanical stress acting on the developer is substantially reduced in comparison with the known technique in which the developer is formed into a thin layer using a thin layer forming member. This arrangement prevents the external additive from burying into the developer. The toner is thus free from a drop in flowability and toner aggregation. The toner is thus free from a reduction in the amount charge with time, and long-term image quality is assured.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
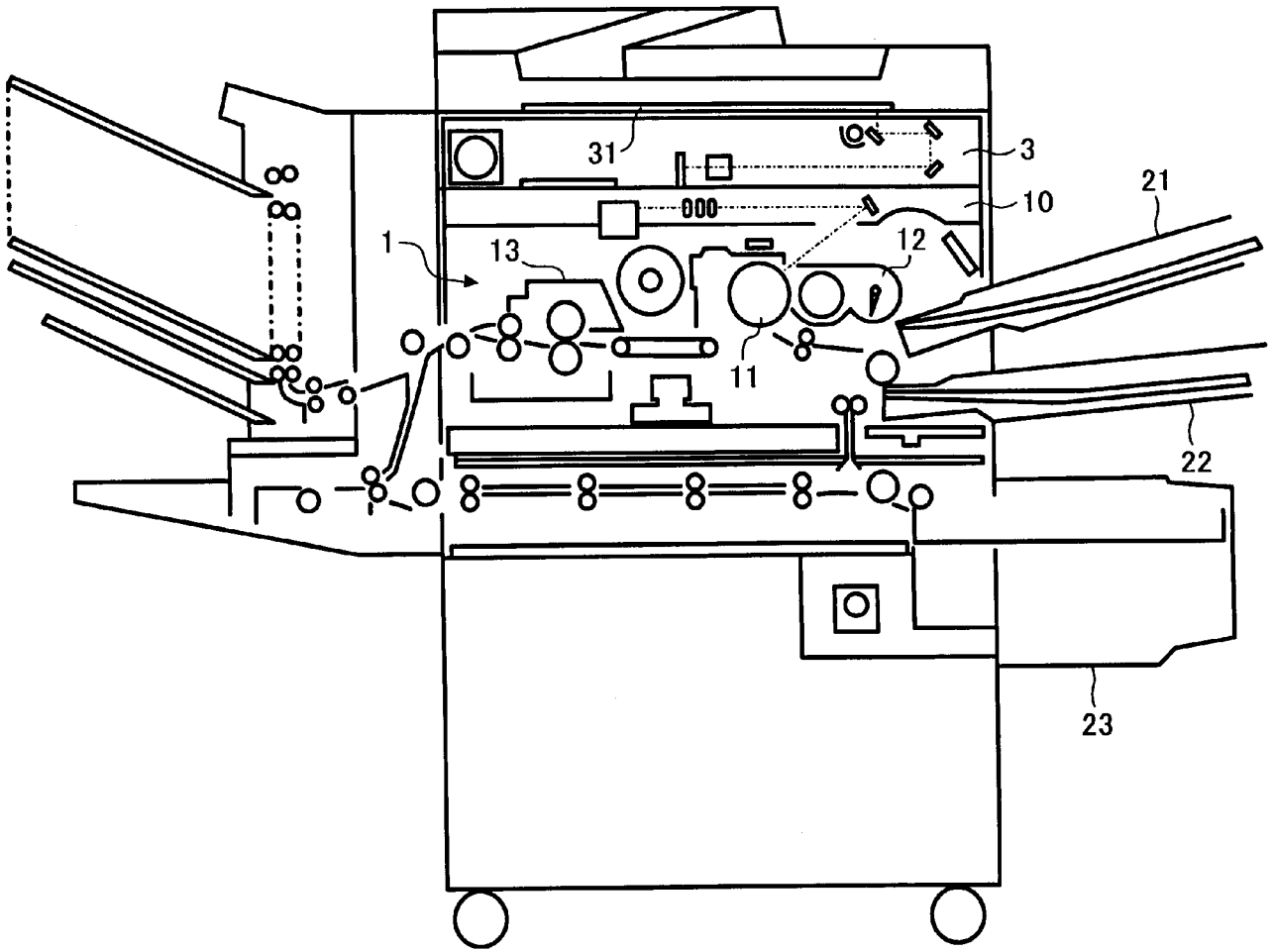
FIG. 1 is a general sectional view of an electrophotographic copying apparatus as an image forming apparatus implementing the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, a copying apparatus according to an exemplary embodiment of the present invention is explained.

As shown, an image forming section 1 is placed in the generally central position of the copying apparatus. Arranged on the right-hand side of the copying apparatus are paper feeder cassettes 21 and 22, and a paper feeder unit 2 having a paper feeder tray 23. A document reader 3 is arranged in the upper portion of the copying apparatus.

In the document reader 3, an original document on a glass platen 31 is illuminated by a light source. An optical scanner system reads the original document. A predetermined image processor converts the read original document information into digital information and then processes the digital image information. An optical writer 10 is driven in response to the image processed signal.

The image forming section 1 includes, around a photoconductive drum 11 (such as an organic photoconductive member) as one example of a latent image carrying member, a charger, a development unit, a transfer unit, a cleaning device, a discharger, and the like. A development unit 12 arranged on the right-hand side of the photoconductive drum 11 will be discussed in detail later. An exposure zone is set up between a charger 2 and the development unit 12. A write beam from the optical writer 10 is directed to the photoconductive drum 11.

The surface of the photoconductive drum 11 is uniformly charged at a predetermined potential. The charged surface of the photoconductive drum 11 is exposed to the write beam, and has an electrostatic latent image thereon. The development unit 12 feeds a toner to the surface of the photoconductive drum 11, thereby forming a toner image. The transfer unit transfers the toner image onto a sheet of recording paper supplied from the paper feeder unit 2. The recording sheet having the toner image thereon is then conveyed to a fixing unit 13. After the toner image is fixed onto the recording sheet, the recording sheet is discharged into an output unit. The toner residing on the photoconductive drum 11 is removed by the cleaning device. A static residing on the photoconductive drum 11 is neutralized by the discharger. The photoconductive drum 11 is now restored back to the original state thereof.

The photoconductive drum 11 has a photosensitive layer which is manufactured by coating an aluminum cylinder with an organic or inorganic photosensitive material. Alternatively, a belt-like photoconductive body that is manufactured by coating thin layer of polyethylene telephthalate (PET), polyethylene naphthalate (PEN), nickel layer, or the like with a photoconductive material may be used. Here, the polarity of the photoconductive material is negatively charged. Alternatively, the photoconductive material may be positively charged taking into consideration the electric charge of the toner. The photoconductive drum 11 has a diameter of 50 mm, and rotates at a linear velocity of 200 mm/s.

The development unit performs one of contact type development process in which a development roller remains in contact with the photoconductive drum 11 and non-contact type development process in which the development roller remains out of contact with the photoconductive drum 11. In the non-contact development process, an alternating electric field is typically used to achieve high-quality imaging. The use of the alternating electric field causes non-uniformities in the thin layer of toner on the development roller to be less pronounced in resulting images. In the non-contact type development process, on the other hand, a direct electric field only is typically used because of its faithful development feature. A first preferred embodiment that performs the contact type development process will now be discussed.

First Preferred Embodiment

Figure 2:
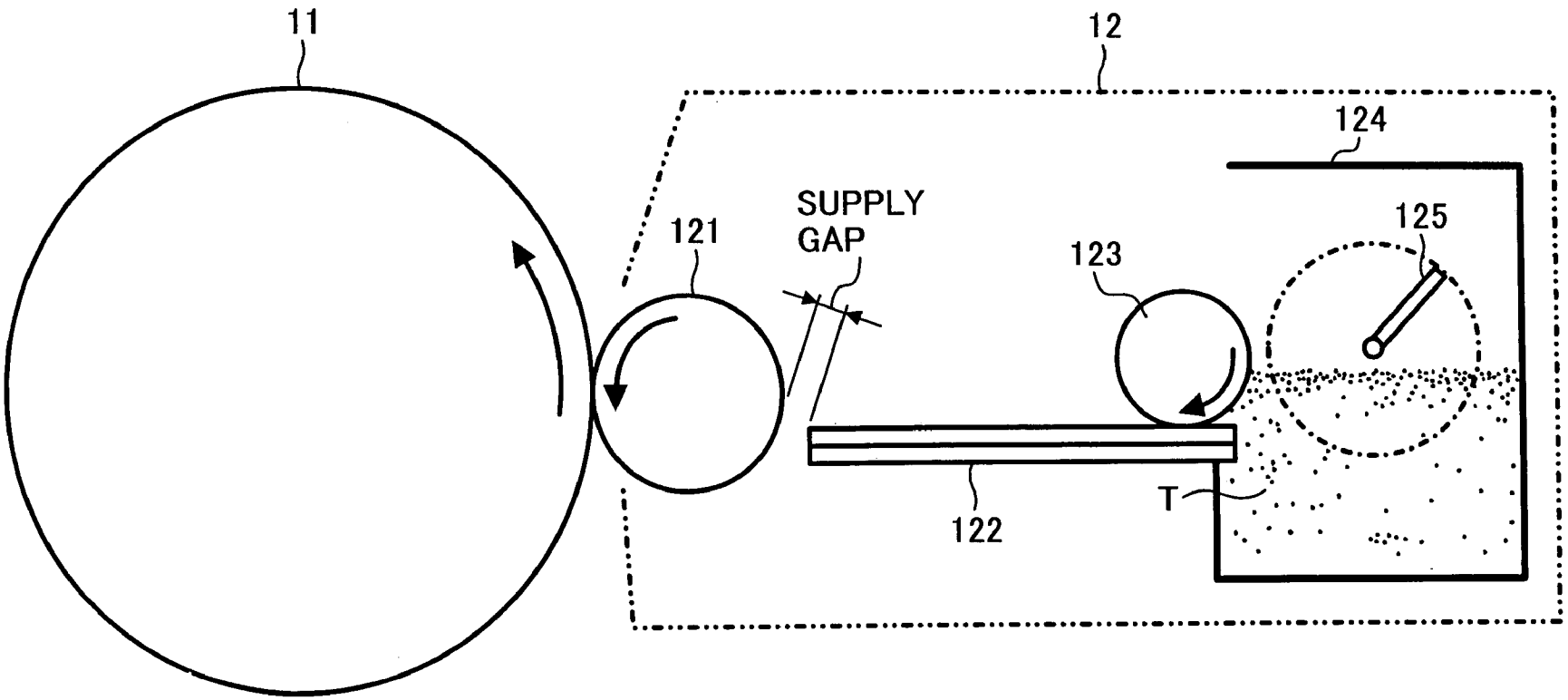
FIG. 2 illustrates a development unit and the surrounding elements thereof for performing a contact development process.

As shown in FIG. 2, the development unit 12 includes a hopper 124, a development roller 121, an electrostatic conveyance member 122, a supply roller 123, etc. The hopper 124 is filled with a toner T. The hopper 124 includes an agitator 125 which agitates the toner while moving the toner T to the supply roller 123. One end of the electrostatic conveyance member 122 extends into the hopper 124. The supply roller 123 is arranged to be in contact with the top surface of the electrostatic conveyance member 122 close to the one end thereof. With the supply roller 123 rotating, the toner T is supplied to the electrostatic conveyance member 122. The toner T is then conveyed toward the development roller 121 based on the mechanism of electrostatic conveyance, and is then supplied to the development roller 121 from the opposite end of the electrostatic conveyance member 122. The toner T is triboelectrically charged (to a negative charge in the first preferred embodiment) when being conveyed by the electric field along and on the electrostatic conveyance member 122. The electric field of the charged toner T causes a thin layer of toner on the development roller 121. The first preferred embodiment requires neither a doctor blade nor a limiting roller. The toner T is one-component non-magnetic toner.

In the first preferred embodiment, the supply roller 123, made of foamed urethane, has a diameter of 14 mm, a hardness of 20° in Japanese Industrial Standard (JIS) A, and a nip impression of 0.3 mm against the development roller. A toner (developer) supply roller used in known one-component toner development units has a nip impression of 1 mm against a development roller. In the known development unit, the toner supply roller has the function of charging the toner. The first preferred embodiment of the present invention does not very much require that the supply roller 123 charge the toner, and the amount of charge as much as −1 μC/g is sufficient.

The electrostatic conveyance member 122 having a planar structure includes a base plate 165 made of an insulator and an electrostatic actuator formed of a plurality of electrodes 164 embedded in the base plate 165 (see FIGS. 3A–3F). The plurality of electrodes (hereinafter referred to as driving electrodes) 164 are long band-like members extending in perpendicular to the page of in FIG. 2 and FIGS. 3A–3F. Mutually adjacent electrodes are connected to different electrode terminals 164*a*, 164*b*, and 164*c*, thereby forming three groups of driving electrodes. With the electrode terminals 164*a*, 164*b*, and 164*c* supplied with voltages as will be discussed later, a driving force is generated by interaction between the charge of the toner and the charge of the base plate, and conveys the toner.

FIGS. 3A–3F illustrate the principle of toner conveyance of the electrostatic actuator in the electrostatic conveyance member 122. The direction of conveyance is rightward in FIGS. 3A–3F, while the direction of conveyance is leftward in FIG. 2. In the first preferred embodiment, the charge of the toner is negative as already discussed. In the example of FIGS. 3A–3F, the toner charge is positive.

Figure 3A:
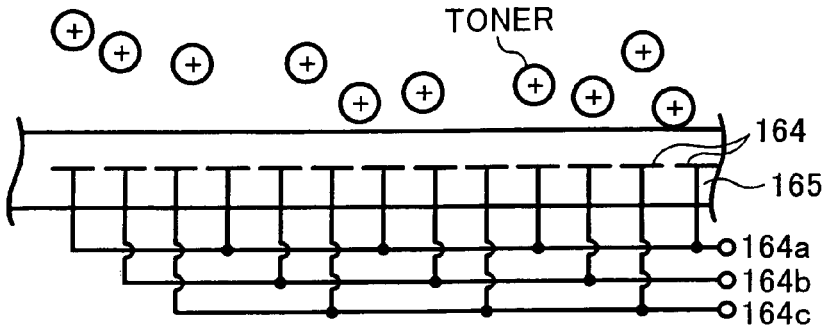
FIGS. 3A–3F illustrate the principle of toner conveyance performed by an electrostatic conveyance member.

As shown in FIG. 3A, the driving electrodes 164 has no charge when the electrode terminals 164*a*, 164*b*, and 164*c* are not biased with voltages. Although the toner is slightly charged by the supply roller 123, the driving electrodes 164 having no charge thereon generates no driving force. The toner is thus not conveyed. The toner is thus floating above the electrostatic conveyance member 122 or sticking to the base plate 165.

Figure 3B:
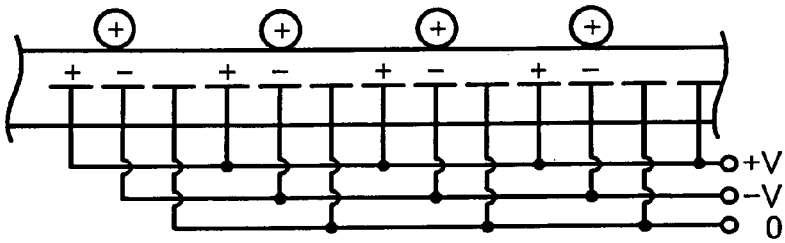

As shown in FIG. 3B, the first electrode terminal 164*a* is positively charged, the second electrode terminal 164*b* is negatively charged, and the third electrode terminal 164*c* is connected to zero volt. The toner is attracted by a driving electrode that is oppositely charged by charge opposite from that of the toner. More specifically, a positively charged toner sticks to the surface of the electrostatic conveyance member 122 of the driving electrodes 164 charged with −V. No toner is attracted by the driving electrodes 164 that is charged with +V, namely, the same polarity of the toner, and by the driving electrodes 164 that are not charged.

Figure 3C:
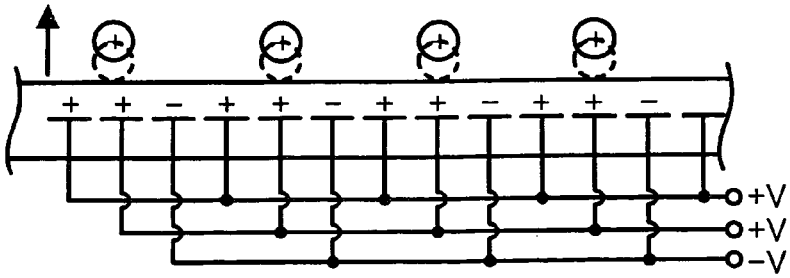
Figure 3D:
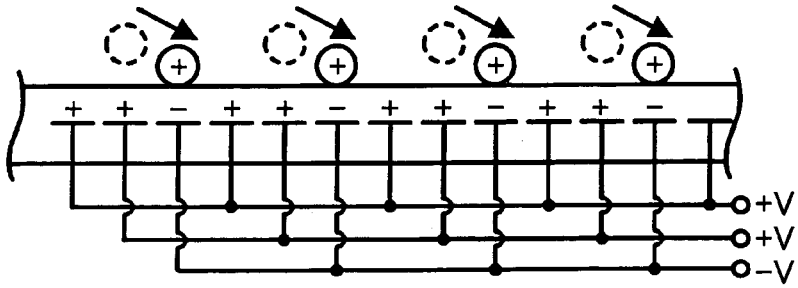

As shown in FIG. 3C, the applied voltages are switched so that the second group of driving electrodes immediately below the sticking toner are biased with +V, namely, the same polarity as that of the toner, the third group of driving electrodes, adjacent to (on the right-hand side of) the second electrode group in the direction of conveyance are biased with −V, namely, the polarity opposite from that of the toner, and the first electrode group, adjacent to the second electrode group in a direction opposite from the direction of conveyance, is biased with +V, namely, the same polarity as that of the toner. Since the polarity of the charge of the toner and the polarity of the charge of the driving electrodes 164 immediately beneath the toner become the same, a repulsive force is generated, thereby lifting the toner. The third electrode group in the direction of conveyance changes from zero to −V, thereby having the charge polarity opposite from that of the toner. The electric charge of the third electrode group attracts the toner on the upper left side thereof. Since the charge of the first electrode group in the direction opposite from the direction of conveyance is opposite in polarity from the charge of the toner, the first electrode group repulses the toner from the upper right side. The driving force working in the rightward direction occurs in the toner. With the toner lifted, friction between the toner and the surface of the electrostatic conveyance member 122 is reduced. The driving force resulting from charge moves the toner by one pitch of the driving electrodes 164.

Figure 3E:
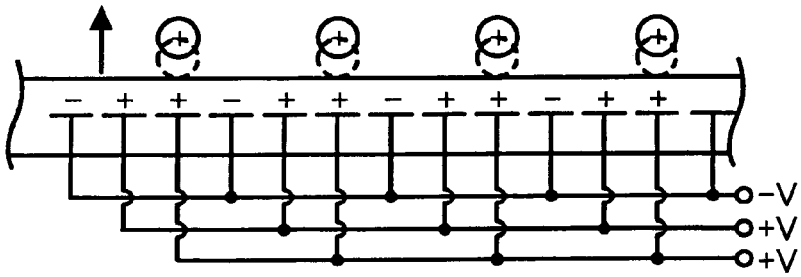
Figure 3F:
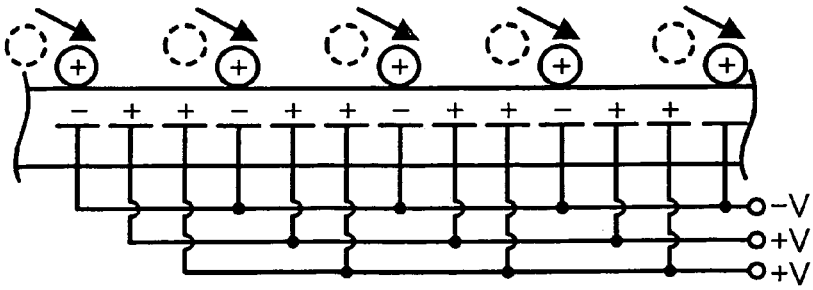

The voltage of patterns (see FIGS. 3C and 3D) for repulsion and driving of the toner is shifted, becoming voltage patterns as shown in FIGS. 3E and 3F. The driving electrodes 164 are biased with the voltage pattern shifted one pitch by pitch, thereby moving the toner continuously. In FIG. 3C, if the third driving electrode group is positively biased while the first driving electrode group is negatively biased, the toner is moved in an opposite direction.

In accordance with the first preferred embodiment, the toner in the toner hopper 124 is fed to the supply roller 123 by the agitator 125, charged (by the friction when the toner is moved by the electric field) while being conveyed by the electrostatic conveyance member 122, and then fed to the surface of the development roller 121. The electric field, generated between the development roller 121 (a development carrying member) and the electrostatic conveyance member 122 (a developer conveyance member), transports the toner from the electrostatic conveyance member 122 to the development roller 121. The toner is supplied using a non-contact manner. A supply gap (see FIG. 2) ranges within 0.1 mm to 0.6 mm. If the supply gap is narrower than this range, toner supplying is performed in a contact manner. If the supply gap is wider than 0.6 mm, a supply voltage difference must be higher than 1 kV, and the possibility of discharging becomes higher. If discharging occurs, the electric field cannot be generated, and a required amount of toner cannot be supplied. An alternating current voltage may be supplied to the development roller 121 to generate an alternating electric field between the development roller 121 and the electrostatic conveyance member 122. With the alternating electric field, a predetermined amount of toner is reliably supplied to the development roller 121.

Figure 4:
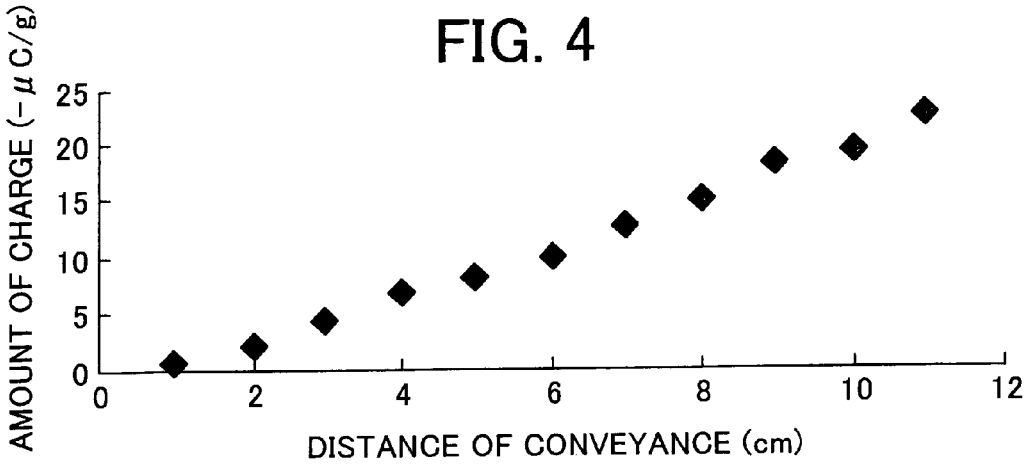
FIG. 4 is a graph plotting the relationship between toner conveyance distance and amount of charge of toner in the electrostatic conveyance member.

In the first preferred embodiment of the present invention, the surface of the electrostatic conveyance member 122 is coated with a material for negatively charging the toner, such as rubber or a resin like silicone, acrylic, polyurethane. The toner is charged while being conveyed by the electrostatic conveyance member 122. As plotted in FIG. 4, the amount of charge of the toner increases with the distance of conveyance. The toner that has reached the end of the electrostatic conveyance member 122 after moving a predetermined distance is fed to the development roller 121.

The toner fed to and carried by the rotating development roller 121 is conveyed to a development zone where the photoconductive drum 11 faces the development roller 121. In the development zone, the toner is applied to the electrostatic latent image on the photoconductive drum 11, thereby visualizing the latent image as a toner image. Toner that has not adhered to the photoconductive drum 11 is circulated back into the development unit 12. The first preferred embodiment performs the contact development process that is performed with the toner layer on the surface of the development unit 12 remaining in contact with the surface of the photoconductive drum 11.

In accordance with the first preferred embodiment of the present invention, the charged toner forms a thin layer on the development roller 121 under the effect of the electric field. The toner is thus free from mechanical stress, unlike in the known development unit using a thin layer forming member. The external additive of the toner is not buried into the toner matrix resin. The toner is not reduced in flowability and free from aggregation. As a result, for a long period of time, the present invention controls image quality degradation such as scumming due to a drop in charge arising from toner aggregation with time.

The toner used with the known development roller is triboelectrically charged in a nip between a supply roller and a development sleeve. In such a triboelectrical process, the toner is subject to a large mechanical stress. The external additive is thus buried into the toner matrix resin. The flowability of the toner drops, thereby causing the toner to aggregate with time. Toner aggregation with time reduces charge capacity of the toner. As a result, image quality degradation such as scumming and supply failure of toner may take place. In accordance with the first preferred embodiment of the present invention, however, the toner is charged by friction with the electrostatic conveyance member 122 when the toner is conveyed by the electric field along the electrostatic conveyance member 122 in the development unit. The toner is thus free from the mechanical stress that acts on the toner in the known development unit. The flowability of the toner is not reduced. The toner is thus free from the scumming due to the drop in the charging capacity and toner supply failure. Since the toner is charged while being conveyed on the electrostatic conveyance member 122, all toner is uniformly charged. If the thin layer of toner is formed on the development roller 121 by using the electric field only, the thin layer of toner becomes uniformly distributed. A high-quality image is thus provided.

Since the electrostatic conveyance member 122 remains out of contact with the development roller 121, mechanical aging of the two elements is reduced, and service life of the two elements is prolonged.

The image forming apparatus of the first preferred embodiment uses a solid photoconductive drum that is manufactured of an aluminum cylinder as the image carrying member, the development roller 121 is preferably made of rubber having a hardness within a range of 10–70° in JIS A Specification. The development roller 121 preferably has a diameter falling within a range of 10 to 30 mm. The development roller 121 has a diameter of 16 mm in the first preferred embodiment. The development roller 121 is roughened to a surface roughness Rz of 1 to 4 μm (measured in ten-point height of irregularities) using any appropriate method. The surface roughness Rz is within a range of 13 to 80 percent of average diameter of the volume of the toner particle, and the development roller 121 carries the toner without allowing the toner to be buried in the surface thereof. The rubber of the development roller 121 may be made of silicone, butadiene, NBR, hydrin, EPDM, or the like.

The use of the belt photoconductive member eliminates the need for reducing the hardness of the development roller 121, and a metal roller may be used. To achieve long-term reliability, the surface of the development roller 121 may be coated with an appropriate material. In accordance with the first preferred embodiment of the present invention, the development roller (the developer carrying member) 121 serves only the purpose of carrying the toner (the developer).

Unlike the known one-component toner development unit, the development roller 121 is free from the function of imparting charge to the toner in a triboelectrical activity between the toner and the development roller. It is sufficient if the development roller 121 satisfies requirements of electrical resistivity, surface features, hardness and dimensional accuracy. This offers a substantially wide range of selection of the material of the development roller 121. Unlike a known two-component toner development unit, the development unit of the first preferred embodiment of the present invention eliminates the need for a magnetic roller. The structure of the development unit is simplified.

The material coating the surface of the development roller 121 is preferably the one that is charged at a polarity opposite from that of the toner. The coating material may be a resin such as silicone, acrylic, or polyurethane, or a material containing rubber. To impart an electrical conductivity to the coating material, the coating material is typically impregnated with an electrically conductive material such as carbon black as necessary. Another resin may be mixed to apply a uniform coating on the development roller. Volume resistivity of the development roller 121 is set to be within a range of $10^3$ to $10^8$ Ωcm taking into consideration the coating layer and a base layer of the development roller 121. Since the volume resistivity of the development roller base layer used in the first preferred embodiment is $10^3$ to $10^5$ Ωcm, the volume resistivity of the coating layer of the development roller 121 must be set to be slightly higher than this range.

Figure 5A:
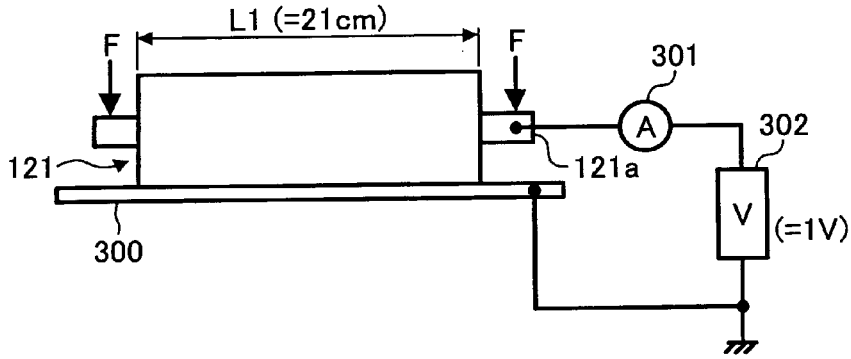
FIGS. 5A and 5B illustrate a method for measuring a volume resistivity on the surface of a development roller.
Figure 5B:
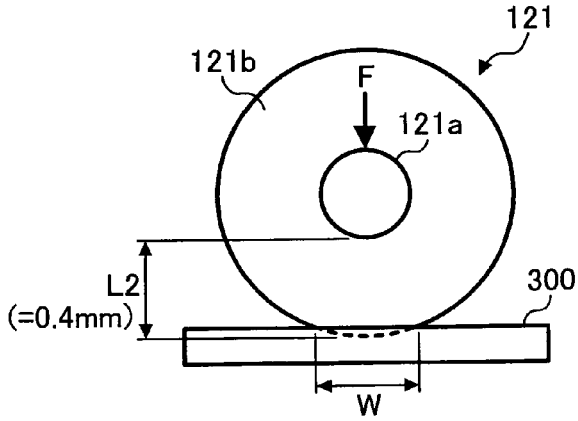

A method for measuring the volume resistivity of the coating layer of the development roller 121 is now discussed with reference to FIGS. 5A and 5B. The development roller 121 to be measured is set on an electrically conductive base plate 300 that is grounded. A force F of 4.9 N (=500 gf) is applied to each of the two ends of a core shaft 121*a* of the development roller 121. A total of force F of 9.8 N (1 kgf) is thus applied to the development roller 121. As shown in FIG. 5B, a nip W is created between the development roller 121 and the base plate 300. A direct current source 302 is connected to the shaft core 121*a* of the development roller 121 through a current meter 301. With a DC voltage of V (=1V) applied to the shaft core 121*a*, a current value I (A) is read. The volume resistivity ρv of an elastic layer 121*b* of the development roller 121 is determined based the applied voltage V (V), the measured current I (A), dimensions L1 (cm), L2 (cm), and W (cm).

$$\rho v=(V/I)\cdot(L1\times W/L2)$$

The thickness of the coating layer of the development roller 121 is preferably within a range of 5 to 50 μm. If the thickness of the coating layer of the development roller 121 is above 50 μm, the development roller 121 is subject to damage such as cracks when stress is caused due to a difference in hardness between the coating layer and the base layer. If the thickness of the coating layer of the development roller 121 is below 5 μm, the base layer may be exposed as the coating layer wears, and the toner tends to stick to the development roller 121.

The toner as the developer is a mixture a charge control agent (CCA), a color material, and a resin such as polyester, polyol, or styrene acrylate. By adding an external additive such as silica or titanium oxide to the periphery of the toner matrix, flowability is increased. The particle size of the external additive is typically within a range of 0.1 to 1.5 μm. The color material may be carbon black, phthalocyanine blue, quinacridone, carmine, or the like. As necessary, the toner matrix, having wax dispersed and mixed therewithin, is mixed with one of the above-referenced external additives.

The mean particle diameter of the toner preferably falls within a range of 3 to 12 μm. The mean particle diameter of the toner used in the first preferred embodiment is 7 μm, and is fine enough to work with a high-resolution image as high as or higher than a resolution of 1200 dpi.

The first preferred embodiment of the present invention uses the negatively charged toner. Alternatively, a positively charged toner may be used depending on the polarity of the photoconductive member.

Second Preferred Embodiment

A second embodiment is discussed below. The second embodiment performs a non-contact development process in which the development roller 121 faces the photoconductive drum 11 with a spacing maintained therebetween. The spacing therebetween is larger than the thickness of the toner layer on the development roller 121.

Figure 6:
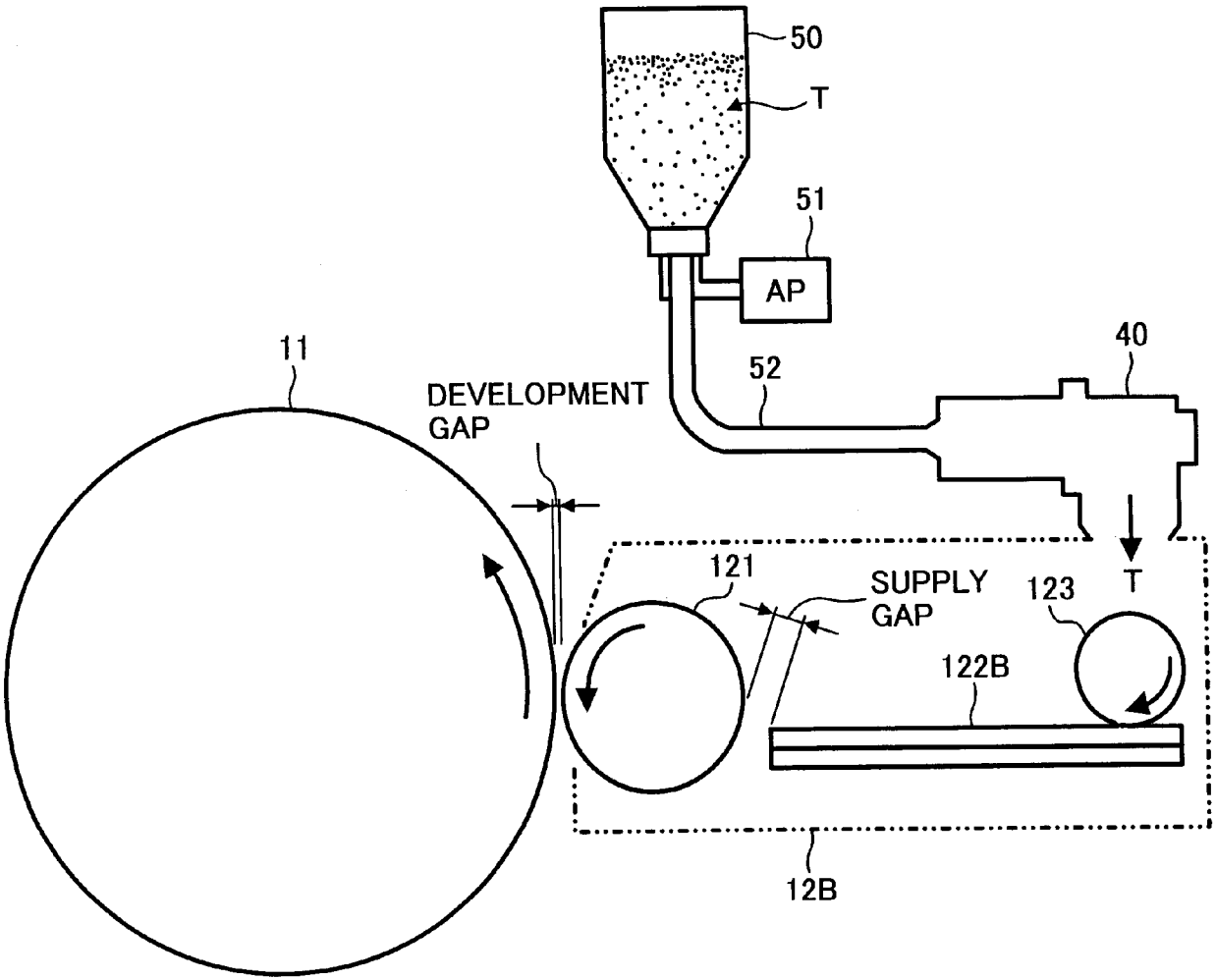
FIG. 6 illustrates a development unit and the surrounding elements thereof for performing a non-contact development process.

FIG. 6 illustrates the development unit and the surrounding elements thereof in accordance with the second preferred embodiment of the present invention. As shown, a development unit 12B includes a powder pump 40. The powder pump 40 feeds the toner T held in a toner cartridge 50, arranged separately from the development unit 12B, into the development unit 12B. The toner T in the toner cartridge 50 is fluidized by air supplied by an air pump 51, and is then supplied to the development unit 12B through a conveyance tube 52 under sucking pressure of the powder pump 40. In the second preferred embodiment of the present invention, a spherical toner is used.

Like the development unit 12 as shown in FIG. 2, the development unit 12B includes the development roller 121, the electrostatic conveyance member 122, and the supply roller 123, but does not includes the hopper 124 and the agitator 125. As shown in FIG. 6, the toner is fed to the supply roller 123 from the powder pump 40, and is then fed to the development roller 121 using the mechanism of electrostatic conveyance.

In the second preferred embodiment, the toner is charged beforehand by the powder pump 40. The surface layer of the electrostatic conveyance member 122B has a resistivity of $10^6$ Ωcm or lower. The second preferred embodiment is identical to the first preferred embodiment in that the electrostatic conveyance member 122B and the development roller 121 are arranged with the supply gap maintained therebetween in a non-contact fashion, and that the effect of the electric field causes a thin layer of charged toner to be formed on the development roller 121. In the development unit 12B of the second preferred embodiment as well, a layer thickness limiting member, pressed into contact with the toner supply roller, such as a doctor blade and a limiting roller, is neither required nor mounted.

Figure 7:
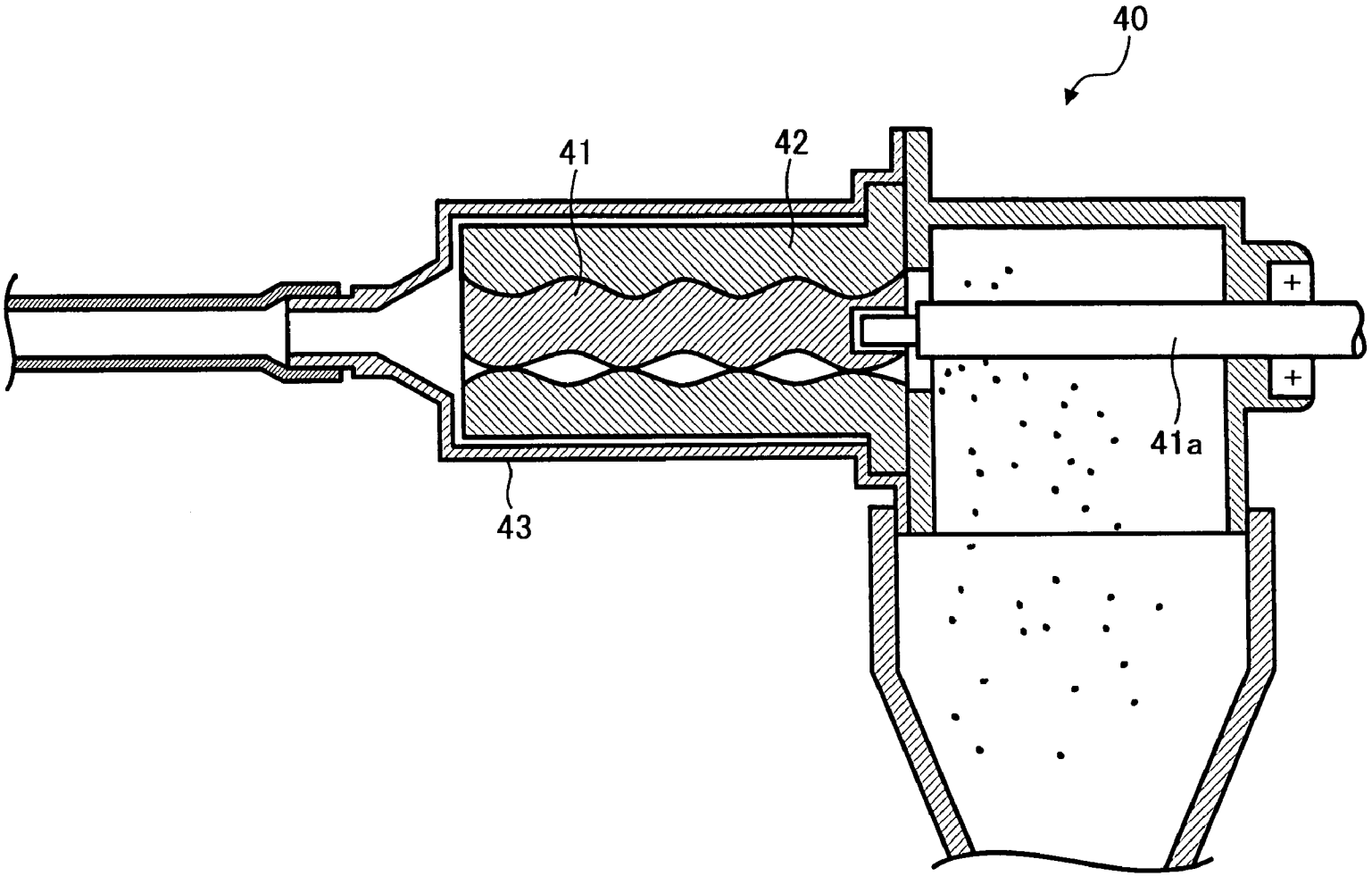
FIG. 7 is a cross-sectional view of a powder pump.

As shown in FIG. 7, the powder pump 40 includes a rotor 41 that is an off-centered screw-like structure made of a material, having rigidity, such as a metal, a stator 42 that is an elastic body made of rubber and having a two-line screw-like shape on the internal surface thereof, and a holder 43 that is made of a resin or the like, surrounds the rotor 41 and the stator 42, and provides a passage for conveying the powder. The rotor 41 is rotationally driven by a gear 44 (not shown) secured to a driving shaft 41*a* that is connected using a pin joint.

Figure 8:
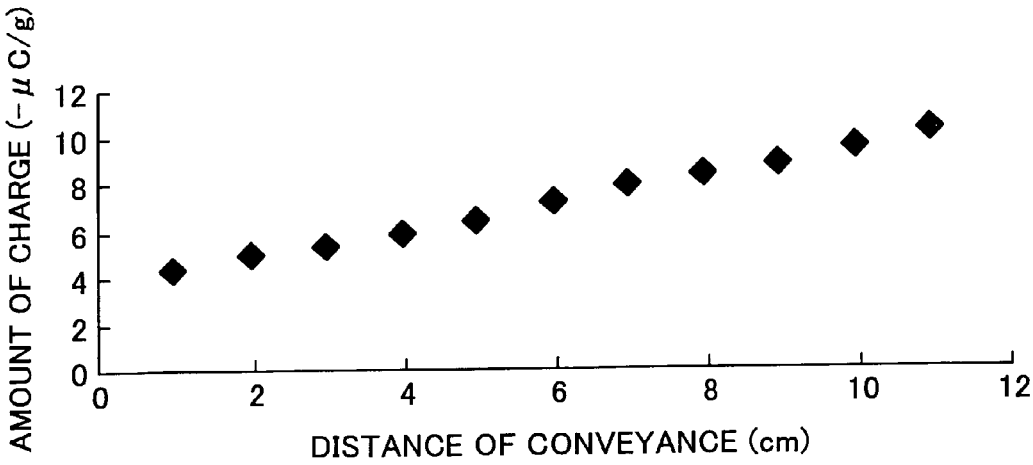
FIG. 8 is a graph plotting the relationship between the toner conveyance distance and the toner charge amount with the powder pump used.

In the powder pump 40 thus constructed, the internal surface of the stator 42 or the surface of the rotor 41 is coated with a material that charges the toner. When the toner reaches the supply roller 123, the toner is already charged. The distance of conveyance of the toner and the amount of charge of the toner in the powder pump 40 have the relationship plotted in FIG. 8. The longer the distance of conveyance, the closer to a saturated amount of charge the toner approaches. The toner T is thus supplied to the electrostatic conveyance member 122B. As the toner is conveyed by the electrostatic conveyance member 122B, the charge of the toner increases as a result of friction with the surface of the electrostatic conveyance member 122B.

With the volume resistivity of the surface of the electrostatic conveyance member 122B set to be equal to or lower than $10^6$ Ωcm, accumulated charge is leaked. No drop is observed in the amount of charge of the toner with time, and toner charge capacity is thus maintained. If the volume resistivity is above $10^6$ Ωcm, the electrostatic conveyance member 122B is charged up, thereby lowering the toner charge capacity.

Figure 9:
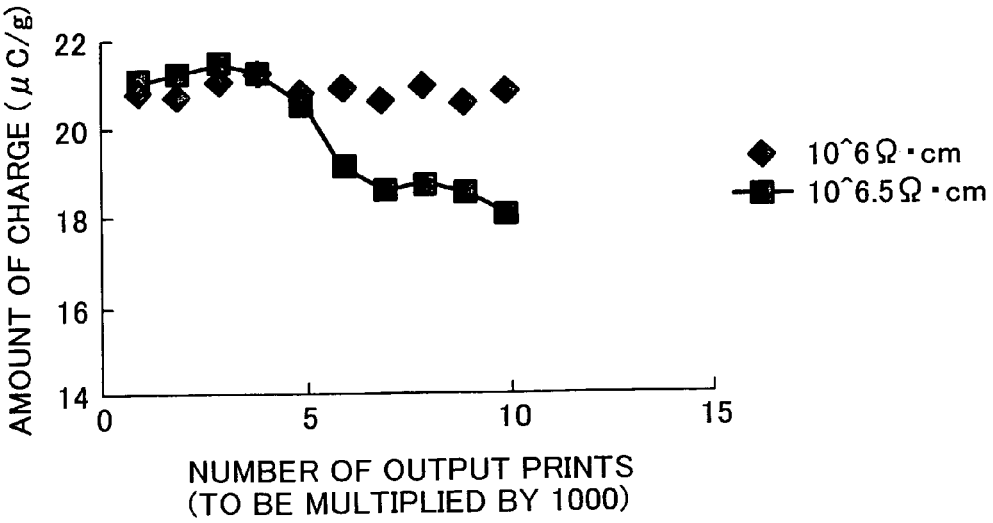
FIG. 9 is a graph plotting the number of output prints and the toner charge amount in accordance a second preferred embodiment of the present invention.

FIG. 9 illustrates the relationship between the number of image prints and the amount of toner charge in the second preferred embodiment of the present invention. With the volume resistivity of the surface of the electrostatic conveyance member 122B at $10^6$ Ωcm, the amount of charge remains unchanged even when the number of image prints exceeds 5000. With the volume resistivity of the surface of the electrostatic conveyance member 122B at $10^{6.5}$ Ωcm, the amount of charge tends to drop when the number of image prints exceeds 5000.

The toner used in the second preferred embodiment of the present invention is now described. The form factor of the toner is determined as below. The form factor of the toner in use, namely, the ratio of the projected area of the toner to the area determined based on the mean diameter of the toner particle is 90% or higher. Typically available toner has a form factor of 90% or less. A toner having a form factor of 0.9 (90%) or more provides a high transfer efficiency. Such a toner is typically manufactured using a polymerization method (including emulsification, suspension, and dispersion). It is also possible to manufacture the toner at a uniform diameter. In an example of the second preferred embodiment of the present invention, the toner manufactured using the polymerization method had a mean diameter of 6 μm, the main resin of the toner was polyester, the additives were silica, and titanium. The form factor was 0.96. A toner that was manufactured as a comparative example had a mean diameter of 6 μm, was made of polyester as the main resin matrix, and employed silica and titanium as the additives. The form factor of the comparative toner was 0.85. Using the two toners, the toner layers were formed on the development rollers 121, and the difference between the two toners was observed using surface profile measuring microscope VF-7000 manufactured by Keyence Corporation. A filling factor of each toner was calculated from the surface irregularity of the thin toner layer scanned using the VF-7000. The filling factor was determined from the integral of the height distribution of the toner with the thickness of the peak of the toner layer set to be 100%. The filling factor of the toner of the second preferred embodiment was 75%, and the filling factor of the comparative toner was 45%. The second preferred embodiment substantially outperforms the comparative example in image quality.

In accordance with the second preferred embodiment of the present invention, the development roller 121 faces the photoconductive drum 11 with a gap maintained therebetween. The gap is within a range from 0.2 to 0.6 mm. The ratio of the rotational velocity of the photoconductive drum 11 to the rotational velocity of the development roller 121 is one. An alternating electric field is applied to the development roller 121 as a development bias. The alternating electric field is added to a DC bias as the development electric field. In accordance with the second preferred embodiment of the present invention, a sine wave or a rectangular wave AC voltage having an amplitude of ±500 to ±1000 V is applied in addition to the DC bias for a better development efficiency. Since this arrangement eliminates the need for placing the photoconductive drum 11 into contact with the development roller 121, the toner, the photoconductive drum 11, and the development roller 121 are less subject to mechanical stress.

In accordance with the second preferred embodiment of the present invention, the toner is charged by the powder pump 40. The thin layer of charged toner is formed on the development roller 121 under the effect of the electric field. The toner is thus free from the mechanical stress that is encountered in the known development unit (such as stress during pre-charging period and thin-layer formation period), and is also free from a drop in flowability. This arrangement prevents the flowability of the toner from being lowered, thereby avoiding scumming due to a drop in the amount of charge arising from toner aggregation, and toner supply failure. The service life of the toner is thus prolonged.

In accordance with the second preferred embodiment of the present invention, a uniform and thin layer of toner is formed because the thin layer of toner is produced on the development roller 121 under the effect of the electric field. A high-quality image is thus produced. Since the electrostatic conveyance member 122 is out of contact with the development roller 121, mechanical degradation is controlled, and service life of these elements is prolonged.

Third Preferred Embodiment

A toner consumed portion where no toner is present and a toner unconsumed portion where toner remains coexist on the surface of the development roller 121 after the development roller 121 has passed by the development zone. When such a development roller 121 reaches the toner supply zone, toner is supplied by the electrostatic conveyance member 122. It is difficult to eliminate the difference in the amount of toner sticking to the development roller 121 between the toner consumed portion and the toner unconsumed portion. If the portions different in the amount sticking toner are left on the surface of the development roller 121, density non-uniformities and residual images take place when the development process is performed in the development zone with the facing photoconductive drum 11. The contact development process with the development roller 121 remaining in contact with the photoconductive drum 11 is more adversely affected by the non-uniformities of thin layer of toner on the development roller 121 than the non-contact development process.

Figure 10:
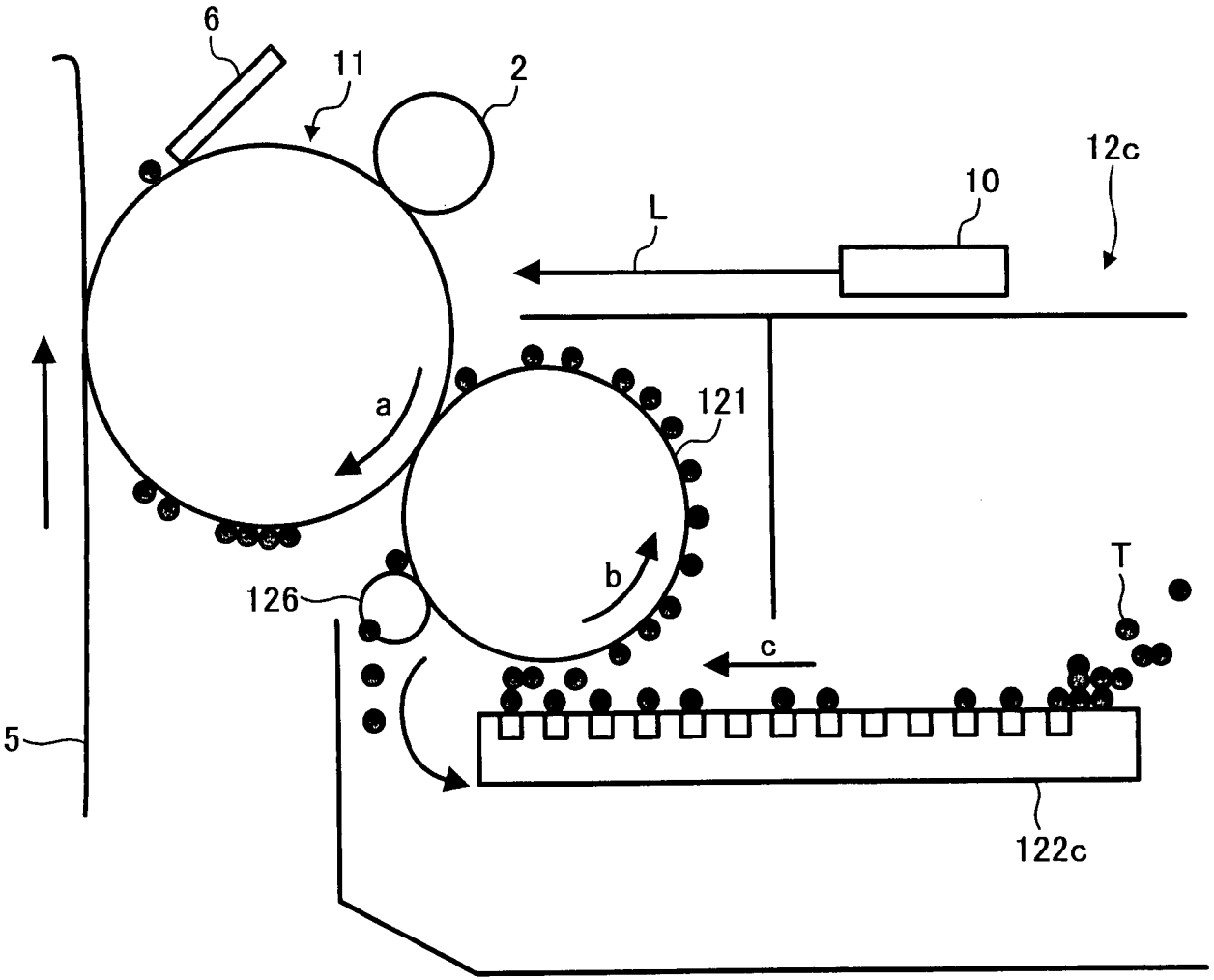
FIG. 10 generally illustrates the structure of an image forming apparatus in accordance with a third preferred embodiment of the present invention.

A development unit 12C of a third preferred embodiment shown in FIG. 10 includes a recovery roller 126 for recovering toner residing on the development roller 121. The recovery roller 126, remaining in contact with the development roller 121, is arranged downstream of the development zone and upstream of the toner supply zone along the direction of rotation of the development roller 121. After the residual toner is recovered, the development roller 121 reaches the toner supply zone. If the recovery roller 126 rotates at a rotational velocity equal to or higher than that of the development roller 121, the residual toner is efficiently recovered.

The recovery roller 126 is fabricated of an electrically conductive core shaft and a surface coating layer covering the core shaft. The surface coating layer may be made of a resin such as silicone, acrylic, or polyurethane. The surface coating layer may also be made of a Teflon® based material such as a material containing rubber with fluorine contained therein. The Teflon-based material containing fluorine having a low surface energy, and an excellent parting feature is less subject to toner filming for a long period of time, and thus provides long-term reliable functions. The resin material of the surface coating layer may include polytetrafluoroethylene (PTFE), tetralfluoroethylene-perfluoroalkyl vinyl ether (PFA), tetrafluoroethylene-hexafluoropropylene polymer (FEP), polychlorotrifluoroethylene (PCTFE), tetrafluoroethylene-ethylene polymer (ETFE), chlorotrifluoroethylene-ethylene polymer (ECTFE), polyvinylidene fluoride (PVDF), polyvinyl fluoride (PVF), or the like. To impart electrical conductivity, the surface coating layer is typically impregnated with an electrically conductive material such as carbon black.

The use of an electrically conductive recovery roller 126 allows a bias voltage to be applied to the toner on the development roller 121, thereby increasing a toner recovery efficiency. During non-printing period, a bias voltage at a polarity opposite from the recovery bias is regularly applied to the recovery roller 126 to detach the recovered toner from the recovery roller 126 and to initialize the recovery roller 126.

The unconsumed toner on the development roller 121 is thus recovered. When the development roller 121 reaches the toner supply zone, a toner supplying electric field formed in the toner supply zone moves the toner charged at the predetermined polarity from an electrostatic conveyance member 122C to the surface of the development roller 121 from which the residual toner has been recovered. The toner newly supplied to the development roller 121 from the electrostatic conveyance member 122C is conveyed to the development zone, and is used to develop a toner image from an electrostatic latent image of the photoconductive drum 11. This arrangement controls image faults such as density non-uniformities due to variations in the amount of sticking toner and residual images.

Figure 11:
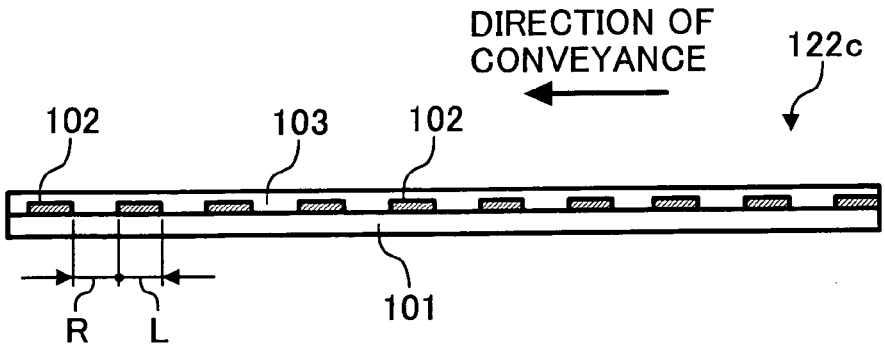
FIG. 11 is a cross-sectional view of a toner electrostatic conveyance board in accordance with the third preferred embodiment of the present invention.
Figure 12:
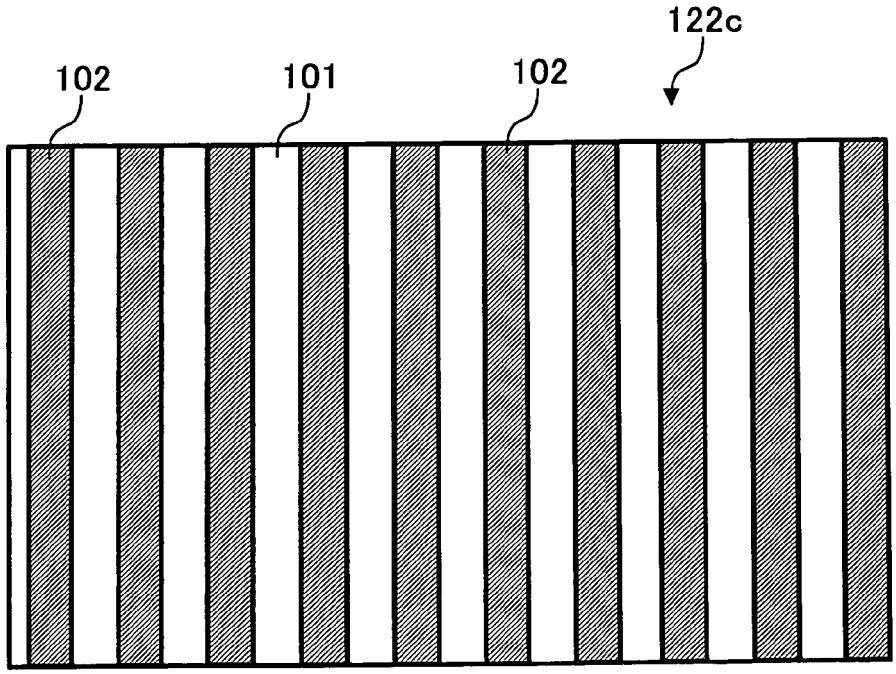
FIG. 12 is a plan view of the toner electrostatic conveyance board in accordance with the third preferred embodiment of the present invention.

The electrostatic conveyance member 122C for conveying the toner using the electrostatic effect in accordance with the third preferred embodiment of the present invention is now discussed. FIG. 11 is a cross-sectional view of a toner electrostatic conveyance member 122C, and FIG. 12 is a plan view of the toner electrostatic conveyance member 122C. The electrostatic conveyance member 122C includes a base plate 101 and a plurality of electrode sets of electrodes 102. Each set includes three electrodes 102, and the electrode sets are arranged at predetermined intervals along the direction of conveyance of toner (in a direction represented by the letter c). The surfaces of the electrodes 102 are coated with a surface protective layer 103 made of an inorganic or organic insulating material. The surface of the surface protective layer 103 serves as a conveyance surface of the toner T. The base plate 101 may be made of an insulating material such as glass, resin, or ceramic. Furthermore, the base plate 101 may be manufactured by coating a stainless steel plate with an insulator made of silicon dioxide, or may be a flexible plate such as polyimide film. The electrodes 102 are manufactured by forming a layer of electrically conductive material, such as gold, aluminum, nickel-chromium, or the like having a thickness of 0.1 to 10 μm, preferably, 0.5 to 2.0 μm on the base plate 101. The resulting electrodes 102 are then patterned to a desired shape using a photolithographic technique or the like. Each of the electrodes 102 has a width L in the direction of conveyance of toner powder ranging from one to twenty times the mean diameter of the toner particle. The spacing R of the electrodes 102 in the direction of conveyance of the toner powder is also one to twenty times the mean diameter of the toner particle. The surface protective layer 103 may be a film of an inorganic material such as $SiO_2$, $TiO_2$, $TiO_4$, SiON, BN, or TiN, $Ta_2O_5$, or an organic material such as silicone based resin, polyimide based resin, polyamide based resin having a thickness of 0.5 to 10 μm, preferably, 0.5 to 3 μm. If a silicone based resin is used for the surface protective layer 103, the toner is easily triboelectrically charged by the contact with the surface protective layer 103 when the toner is conveyed on the electrostatic conveyance member 122C. The toner is thus sufficiently charged. In the development unit 12C of the third preferred embodiment, the toner that has the amount of charge of −0.1 fC/μm or less at the time of supply to the development roller 121 reaches a level of −0.2 to −0.3 fC/μm appropriate for development and sufficient enough to cause the toner to fly to the development roller 121. The development unit 12C also includes a power supply for applying n-phase voltages to the electrodes 102 to generate a moving electric field between the electrodes 102 of the electrostatic conveyance member 122C. The moving electric field is used to convey the toner across the electrodes 102.

Figure 13:
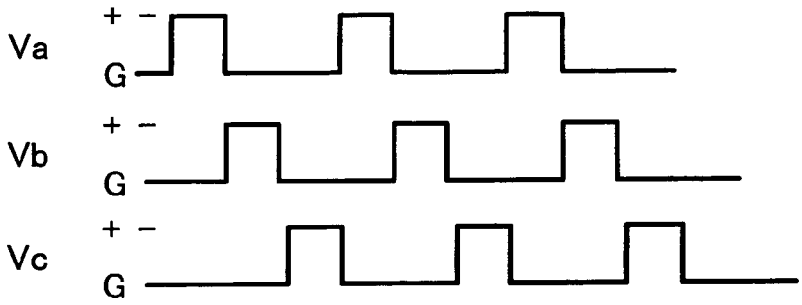
FIG. 13 illustrates the mechanism of the toner electrostatic conveyance of toner electrostatic conveyance board in accordance with the third preferred embodiment of the present invention.
Figure 14:
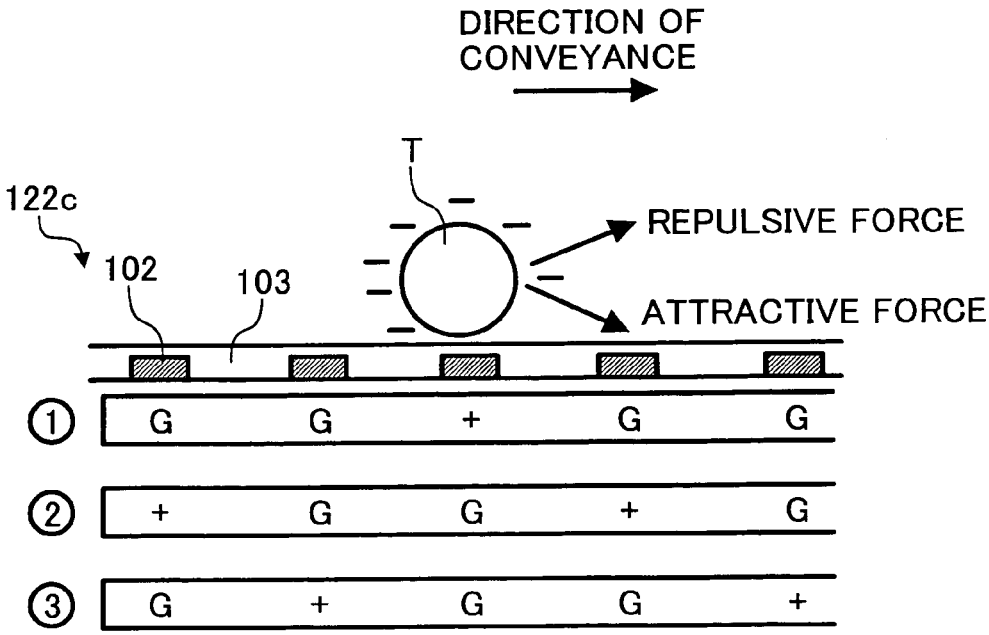
FIG. 14 illustrates the mechanism of the toner electrostatic conveyance of toner electrostatic conveyance board in accordance with the third preferred embodiment of the present invention.

The mechanism for electrostatic conveyance of the toner in the electrostatic conveyance member 122C of the third preferred embodiment is now discussed with reference to FIGS. 13 and 14. The plurality of electrodes 102 in the electrostatic conveyance member 122C generates a shifting electric field (traveling electric field) with the n-phase driving voltages applied thereto. The charged toner on the electrostatic conveyance member 122C is subject to repulsive force and/or attractive force under the presence of the electric field, and hops and moves in the direction of conveyance. As shown in FIG. 14, for example, three-phase pulse driving voltages A (phase A), B (phase B), and C (phase C) swinging between a positive voltage and ground G potential are applied in different timings to the plurality of electrodes 102 in the electrostatic conveyance member 122C. Referring to FIG. 14, a negatively charged toner T is present on the electrostatic conveyance member 122C. If a plurality of consecutive electrodes 102 of the electrostatic conveyance member 122C is supplied with "G", "G", "+", "G", and "G" as shown in (1) of FIG. 14, the negatively charged toner particle is placed at a "+" electrode 102. At a next timing, the electrodes 102 are respectively supplied with "+", "G", "G", "+", and "G" as shown in (2) of FIG. 14. The "G" electrode 102 on the left-hand side exerts a repulsive force on the negatively charge toner T while the "+" electrode 102 on the right-hand side exerts an attractive force on the negatively charged toner T. The negatively charged toner T moves toward the "+" electrode 102. At a subsequent timing, the electrodes 102 are supplied with "G", "+", "G", "G", and "+" as shown in (3) of FIG. 14. Likewise, a repulsive force and an attractive force act on the negatively charged toner T. The negatively charged toner T is further moved to the "+" electrode 102.

The surface protective layer 103 and the electrode width L and electrode spacing R of the plurality of electrodes 102 in the electrostatic conveyance member 122C for hopping operation are discussed next. The electrode width L and the electrode spacing R of the electrostatic conveyance member 122C significantly affect the conveyance efficiency and hopping efficiency of toner. A toner particle, present between one electrode 102 and another electrode 102, moves to the other electrode 102 under the presence of substantially horizontally aligned electric field. In contrast, a toner particle on one electrode 102 is given an initial velocity having at least a vertical component, and most of toner particles depart and fly from the surface of the electrostatic conveyance member 122. A toner particle present close to the edge of the electrode 102 moves and flies over the adjacent electrode 102. If the electrode width L is wide, the toner particles traveling a large distance increase in number. The efficiency of conveyance is thus increased. If the electrode width L is too wide, the toner particle sticks to the electrode because the intensity of electric field is lowered in the center of the electrode 102. The efficiency of conveyance thus drops. The inventors of this invention have found an appropriate electrode width that allows the toner powder to be conveyed at a high efficiency and to be hopped at a high hopping efficiency with a low voltage.

The intensity of the electric field is determined by distance R and applied voltage. The narrower the electrode spacing R, the stronger the electric field in intensity, and the initial velocity in conveyance and hopping is more easily obtained. However, the distance of conveyance of the toner moving from one electrode 102 to another electrode 102 is short per conveyance cycle. The frequency of the driving voltage must be heightened to increase the efficiency of conveyance. The inventors of this invention have also found an appropriate electrode spacing that achieves efficient conveyance and hopping with a low voltage.

The thickness of the surface protective layer 103 covering the electrodes also affects the intensity of the electric field on the surface of the electrode. The inventors of the invention have also found that the thickness of the surface protective layer 103 significantly affects the electric lines of force in a vertical direction, and determines the hopping efficiency. By setting an appropriate relationship among the electrode width L, and the electrode spacing R of the electrostatic conveyance member 122C and the thickness of the surface protective layer 103, the toner attraction to the electrode surface is overcome. The toner conveyance with a low voltage is thus efficiently performed.

Figure 15:
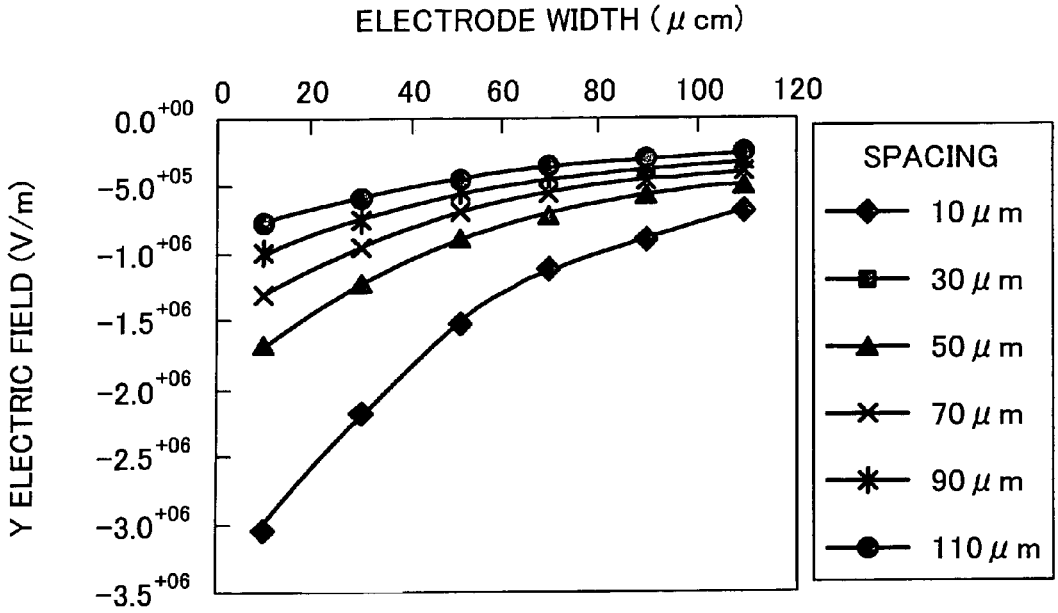
FIG. 15 illustrates an electrode width and an electrode spacing of the toner electrostatic conveyance board and an electric field in the Y direction relating to the flying of the toner.

FIG. 15 is a graph plotting the electrode width L and the electrode spacing R with respect to the electric field in the Y direction for hopping the toner. If the electrode width L is equal to the diameter of a single toner particle, at least a single toner particle is conveyed and hops. If the electrode width is narrower than the particle diameter, electric field becomes weak, resulting in low conveyance power and low flying power. The electrode having the narrow width is thus impractical. As the electrode width L widens, the electric lines of force are aligned in the direction of travel (i.e., in a horizontal direction), the electric field weakens in a vertical direction particularly above the center of the surface of each electrode. The resulting hopping force weakens. In extreme cases, if the electrode width L is too wide, mirror-image force, van der Waals forces, and attractive force by moisture, etc. acting on the charge of the toner become too large, causing the toner to deposit on the electrostatic conveyance member 122C. In terms of the conveyance efficiency and the hopping efficiency, the electrode 102 having a width L that accommodates about 20 toner particles thereon is less subject to attractive force, and the conveyance operation and the hopping operation are efficiently performed with a driving voltage as low as 100 V. An electrode 102 wider than the width of about 20 toner particle diameters causes an attractive force to take place in a localized area. More specifically, the electrode width L preferably falls within a range of from 5 to 100 μm if the mean value of toner particle diameter is 5 μm.

Preferably, the electrode width L is within a range of twice to 10 times the mean value of toner particle diameter in order to achieve an efficient driving with a driving voltage as low as 100 V. With the electrode with L within this range, a drop in the intensity of electric field in the vicinity of the center of the surface of the electrode is controlled to one-third or less, and a drop in the hopping efficiency is controlled to 10% or less. No large drops in the efficiencies are thus created. More specifically, the electrode width L falls within a range of 10 to 50 μm if the mean toner particle diameter is 5 μm. More preferably, the electrode width L falls within a range of twice to six times the mean toner particle diameter. More specifically, the electrode width L falls within a range of 10 to 30 μm if the mean toner particle diameter is 5 μm. The electrode width L within this range significantly improves the conveyance efficiency and the hopping efficiency.

The bias voltage applied to the electrostatic conveyance member 122C for generating the traveling electric field has a polarity in the toner supply zone so that the toner moves toward the development roller 121. The bias voltage applied to the electrostatic conveyance member 122C may be changed depending on the gap between the development roller 121 and the electrostatic conveyance member 122C. Preferably, the gap between the development roller 121 and the electrostatic conveyance member 122C remains substantially the same in the toner supply zone and a zone that continues to the toner supply zone. More specifically, the electrostatic conveyance member 122C is curved in the zone that continues to the toner supply zone, and the gap between the development roller 121 and the electrostatic conveyance member 122C gradually widens as the toner proceeds downstream in the direction conveyance. When a negatively charged toner is used, a bias voltage from zero to −V1 is preferably applied to the electrodes 102 in the electrostatic conveyance member 122C in the toner supply zone, and a bias voltage from zero to +2V is preferably applied to the electrodes 102 in the electrostatic conveyance member 122C in the zone that continues to the toner supply zone. For this voltage setting, a clamp circuit is preferably included in a circuit that generates a driving voltage to be applied to the electrodes 102 of the electrostatic conveyance member 122C.

In the development unit 12C of the third preferred embodiment of the present invention, the movement velocity Vs of the toner along the electrostatic conveyance member 122C is expressed by the electrode pitch (namely, the electrode width L plus the electrode spacing R) of the electrodes 102 formed on the electrostatic conveyance member 122C and the frequency of the driving voltages applied to the electrostatic conveyance member 122C. When the toner conveyance velocity Vs on the electrostatic conveyance member 122C becomes almost equal to the linear velocity Vd of the development roller 121, the toner carried by the development roller 121 is distributed in non-uniformities reflecting the electrode pitch of the electrostatic conveyance member 122C. Density non-uniformity is created in an image developed on the photoconductive drum 11. If the toner conveyance velocity of the electrostatic conveyance member 122C and the linear velocity of the development roller 121 are related as being $|Vs|>|Vd|$, the toner carried by the development roller 121 is free from toner non-uniformities reflecting the electrode pitch of the electrostatic conveyance member 122C. The toner flies in a state in which the difference between the two velocities alleviates the toner non-uniformity due to the electrode pitch, and is then carried by the development roller 121. A thin layer of toner having less non-uniformity results, and a high-quality image having less toner non-uniformity is thus achieved.

To assure a sufficient amount of toner supply to the photoconductive drum 11, the linear velocity Vd of the development roller 121 is typically set to be higher than the linear velocity Vp of the photoconductive drum 11. The ratio of the linear velocity Vp of the photoconductive drum 11 to the linear velocity Vd of the development roller 121, Vp/Vd, alleviates the effect of toner non-uniformity due to the electrode pitch of the development roller 121 on the image non-uniformity. The inventors of the present invention also have found that the human eyes are typically insensitive to the density non-uniformity equal to or smaller than 20 μm. A relationship $P/\{(Vd/Vp)(Vs/Vd)\}<20$ μm holds where P represents the electrode pitch of the electrostatic conveyance member 122C, Vs/Vd represents the ratio of the linear velocity Vd of the development roller 121 to the toner conveyance velocity Vs along the electrostatic conveyance member 122C, and Vd/Vp represents the ratio of the surface movement velocity Vp of the photoconductive drum 11 to the linear velocity Vd of the development roller 121. That relationship shows that the effect of the electrode pitch is thus alleviated by the ratio of the linear velocity Vd of the development roller 121 to the toner conveyance velocity Vs along the electrostatic conveyance member 122C and the ratio of the surface movement velocity Vp of the photoconductive drum 11 to the linear velocity Vd of the development roller 121, and that the image non-uniformity is reduced to 20 μm or smaller. With this equation satisfied, the image non-uniformity due to the electrode pitch is reduced to a level that is almost invisible to the human eyes. In a specific example, the development unit 12C conveyed the toner with the electrostatic conveyance member 122C driven with the electrode pitch of 0.18 mm, a driving voltage of −100 V, and a driving frequency of 2.5 kHz. A development process was performed with the linear velocity Vp of the photoconductive drum 11 at 180 mm/s, the ratio of the linear velocity Vp of the photoconductive drum 11 to the linear velocity Vd of the development roller 121 at 1.25, and the linear velocity Vd of the development roller 121 at 225 mm/s. The amount of toner sticking to the development roller 121 was 0.3 to 0.5 $mg/cm^2$, and a high-quality image with no pitch non-uniformity recognizable was obtained.

Figure 16:
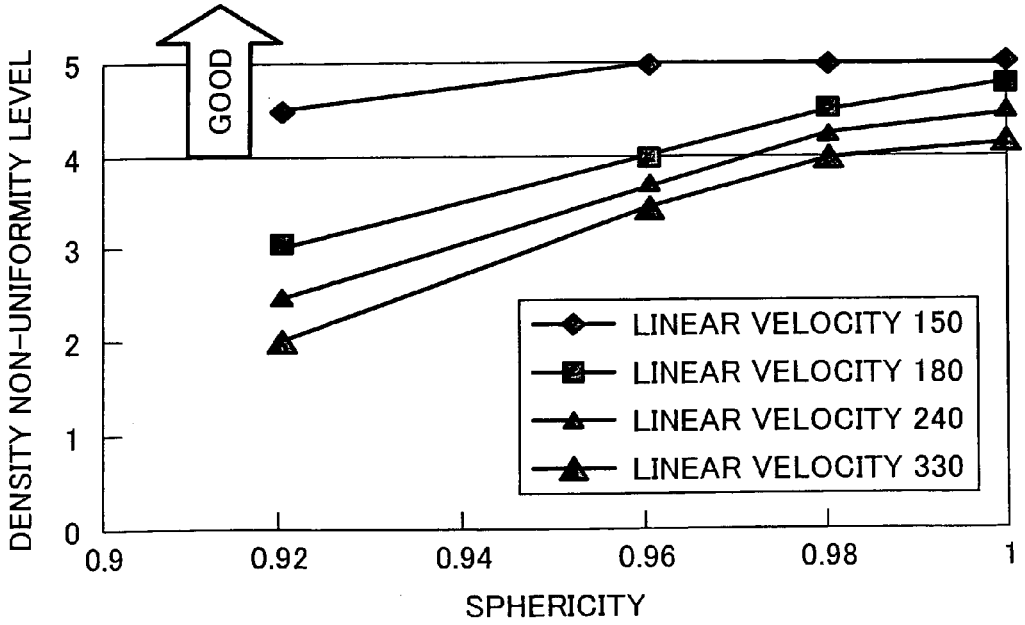
FIG. 16 plots the relationship between the sphericity of the toner and the non-uniformity of image in the image forming apparatus.

The toner used in the third preferred embodiment preferably has a sphericity greater than 0.96 if measured using a flow-type particle image analyzer. Toner conveyance on the electrostatic conveyance member 122C becomes stabilized if the sphericity of the toner in use is larger than 0.96. An image free from the pitch non-uniformity is thus obtained. With the toner sphericity smaller than 0.96, the contact surface of the electrostatic conveyance member 122C is changed if the toner conveyance velocity increases. A difference occurs in non-electrostatic attractive forces, thereby making it difficult for the electrostatic conveyance member 122C to convey the toner in a uniform fashion, and thereby leading to an image having toner non-uniformity. FIG. 16 plots the relationship among image non-uniformity level, the linear velocity of the photoconductive drum 11, and sphericity of the toner particle. If an image having a level 4 of the image non-uniformity is classified as a good image, the sphericity of the toner greater than 0.96 is preferable.

Figure 17:
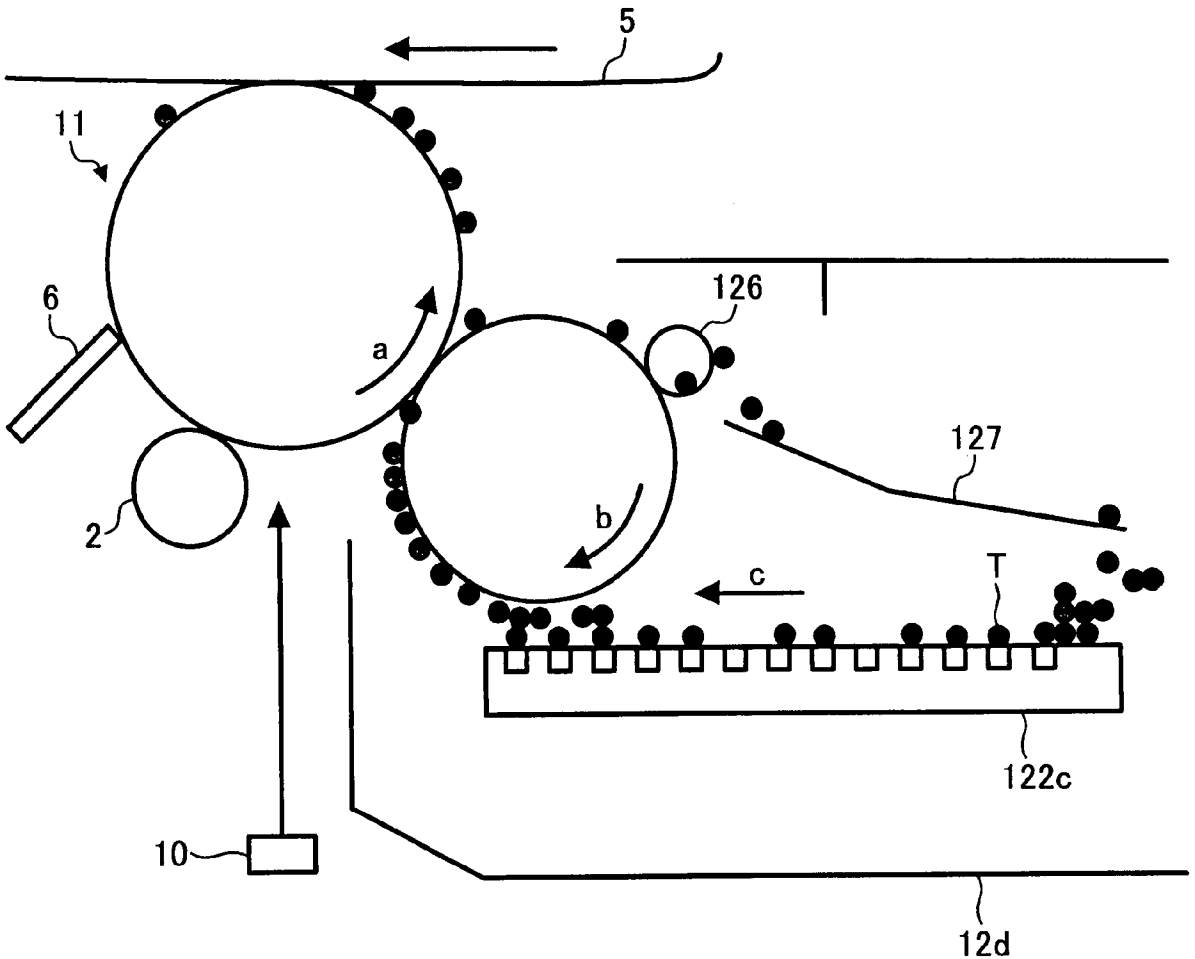
FIG. 17 illustrates an image forming apparatus in accordance with a modification of the third preferred embodiment of the present invention.

As shown in FIG. 17, the direction of rotation (represented by an arrow "b") of the development roller 121 in the toner supply zone may be in the same direction as the toner conveyance direction (represented by an arrow "c") on the electrostatic conveyance member 122C. A cleaning blade 127 for recovering toner on the recovery roller 126 may be arranged. The cleaning blade 127 cleans the recovery roller 126 and transports the recovered toner to the electrostatic conveyance member 122C. The recovery path in a development unit 12D in this case is short, resulting in a compact apparatus.

A toner charge amount changing unit may be arranged downstream of the development zone and upstream of the toner supply zone along the direction of rotation of the development roller 121. It is important that the toner charge amount changing unit changes the amount of charge of the toner on the development roller 121. The toner charge amount changing unit is not limited to any type having any particular structure and made of any particular material. The third preferred embodiment of the present invention includes a charge control roller including a core roller and a surface portion formed of a surface coating layer covering the core roller. The charge control roller is arranged to face the surface of the development roller 121 in the middle of a path within which the surface of the development roller 121 moves from the development zone to the toner supply zone. The material of the surface portion of the charge control roller affects the mechanism in which the amount of charge of the toner on the development roller 121 is changed. For example, when the amount of charge of toner on the development roller 121 is changed through charge injection, charge injection is performed by the charge control roller or the development roller 121, whichever has a smaller electrical resistance (volume resistivity) on the surface thereof. If the material of the surface portion of the charge control roller is a material that is charged at a polarity opposite from that of the toner, the charge control roller changes the amount of charge of the toner on the development roller 121 by triboelectrically charging the toner as a result of friction between the surface of the charge control roller and the toner. The charge control roller may be entirely made of an electrically conductive material. The charge control roller may be grounded, or may be biased to an appropriate voltage by a mechanism that changes the amount of charge of toner. In this case, the amount of charge of toner (the polarity and the absolute value thereof) on the development roller 121 is changed by the charge injection by the charge control roller.

The toner charge amount changing unit changes the amount of charge of toner to the toner of the toner consumed portion with the toner thereof consumed in the development zone and the toner of the toner unconsumed portion so that these toners are movable to the electrostatic conveyance member 122C in the toner supply zone. Upon reaching the toner supply zone, the toner on the development roller 121 with the amount of charge thereof changed moves to and is recovered to the electrostatic conveyance member 122C. The toner supply electric field generated in the toner supply zone feeds the toner T charged at a predetermined polarity from the electrostatic conveyance member 122C to the surface of the development roller 121 from where the residual toner has been recovered. The toner on the development roller 121 newly supplied from the electrostatic conveyance member 122C is conveyed to the development zone, and is then used to develop an image from a latent image on the photoconductive drum 11. This arrangement controls image faults such as the density non-uniformity and residual images due to the non-uniformity in the amount of toner sticking to the surface of the development roller 121.

The preferred embodiments of the present invention have been discussed. The present invention is not limited to the above-referenced embodiments. For example, the polarities of the toner charge and photoconductive drum 11 may be reversed from those in the preferred embodiments discussed above. In this case, the polarity of the voltage applied to the electrostatic actuator is determined depending on the toner in use.

The volume resistivity of the surface of the electrostatic conveyance member 122 in accordance with the first and second preferred embodiments that perform the contact development process may be $10^6$ Ωcm or lower.

Figure 18:
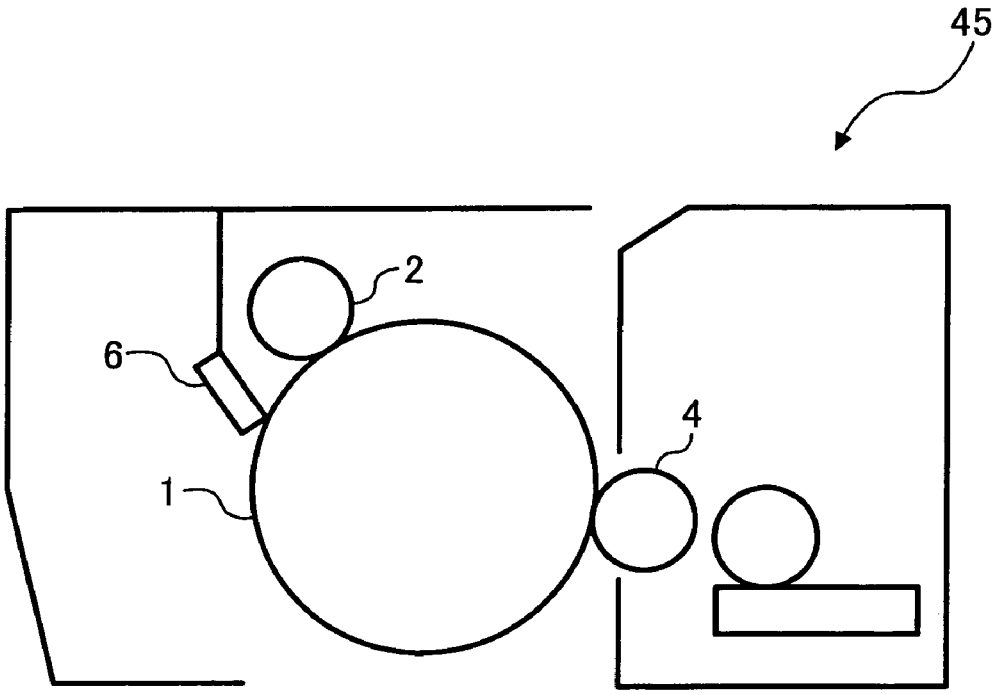
FIG. 18 illustrates a process cartridge.

At least the photoconductive drum and the development unit may be integrated into a unitary body as a process cartridge, and the process cartridge may be detachably mounted into an image forming apparatus such as a copying apparatus or a printer. Referring to FIG. 18, a photoconductive drum, a charger, a development unit, and a cleaning device 6 are integrated into a unitary body as a process cartridge 45. In the process cartridge 45, toner T scattered from a development roller 121 is recovered by a photoconductive drum 1. Since the scattered toner is recovered into the process cartridge 45, the inside of the apparatus is free from contamination of toner dirt.

The present invention is not limited to an image forming apparatus that directly transfers the toner image from a photoconductive drum to a recording sheet. The present invention is applicable to an image forming apparatus that causes a toner image via an intermediate transfer member. The present invention is also applicable to an image forming apparatus that forms a multi-color image or a full-color image. The present invention is applicable to a full-color image forming apparatus which includes a plurality of development units arranged around a photoconductive member (a latent image carrying member). The present invention is also applicable to a full-color image forming apparatus which includes a revolver type development assembly with respect to a photoconductive member. The revolver type development assembly includes a plurality of rotatably supported development units. The present invention is also applicable to a so-called tandem type color image forming apparatus in which a plurality of photoconductive members (latent image carrying members) arranged in tandem.

In accordance with the preferred embodiments of the present invention, the charged toner flies to the development roller under the effect of the electric field, thereby forming a thin layer of toner on the development roller. The toner is thus free from the mechanical stress that is encountered in the thin-layer forming member in the known development unit. The external additive is not buried into the resin matrix of toner, and flowability of toner is not lowered. As a result, for a long period of time, the present invention controls image quality degradation such as scumming due to a drop in the amount of charge arising from toner aggregation with time.

The development unit of the first preferred embodiment of the present invention develops the toner image from the latent image by feeding the thin layer of toner on the development roller to the photoconductive drum in the contact development process. Even with the direct electric field, the latent image is developed into the toner image in a faithful manner.

The development unit of the second preferred embodiment of the present invention generates an alternating electric field to the development roller, and feeds the thin layer of toner on the development roller to the photoconductive drum in the non-contact development process. This arrangement reduces mechanical aging of the development roller and the photoconductive drum, thereby prolonging the service life thereof. The use of the alternating electric field causes non-uniformity in the thin layer of toner on the development roller to be less pronounced in the resulting image.

The toner on the electrostatic conveyance member is conveyed to the developer supply zone under the effect of the electric field of the electrostatic conveyance member. The toner is thus free from the mechanical stress that is encountered in the conveyance process to the development supply zone in the known development unit in which the toner is conveyed to the development roller while being agitated by the supply roller at the same time. Flowability of toner is not lowered. As a result, the present invention controls image quality degradation such as scumming due to a drop in the amount of charge arising from toner aggregation and toner supply failure.

The toner is triboelectrically charged as a result of friction with the electrostatic conveyance member when the toner is conveyed on the electrostatic conveyance member under the effect of the electric field. The toner is thus free from the mechanical stress that is encountered in the known development unit during a triboelectrical process. Flowability of toner is not lowered. As a result, the present invention controls image quality degradation such as scumming due to a drop in the amount of charge arising from toner aggregation and toner supply failure. Since the toner is charged in the conveyance process on the electrostatic conveyance member, all toner particles are uniformly charged. Even when the thin layer of toner is formed on the development roller under the effect of the electric field only, uniform thin layer of toner is thus formed. A high-quality image is obtained.

The electrostatic conveyance member is coated with the surface protective layer made of a silicone resin. If a silicone resin is used for the surface protective layer, the toner is easily triboelectrically charged as a result of friction with the surface protective layer while being conveyed on the electrostatic conveyance member. The toner is thus sufficiently charged.

Since the alternating electric field is generated between the development roller and the electrostatic conveyance member with an alternating current voltage applied to the development roller, the toner is reliably fed to the development roller. This arrangement controls the non-uniformity in the thin layer of toner.

The movement velocity Vs of the toner moving along the electrostatic conveyance member 122 and the linear velocity Vd of the development roller satisfy the relationship of $|Vs|>|Vd|$. In this arrangement, the toner carried by the development roller does not reflect the electrode pitch of the electrostatic conveyance member. The toner is carried by the development roller with the toner non-uniformity due to the electrode pitch alleviated by the velocity difference between the two velocities. The uniform thin layer of toner is formed with the toner non-uniformity reduced. High-quality images free from non-uniformity are thus obtained for a long period of time.

Since the powder pump feeds the toner from the toner cartridge to the electrostatic conveyance member, the toner is sufficiently charged. The use of the powder pump heightens toner supply capability, thereby keeping pace with a higher linear velocity of the development roller.

The toner consumed portion where no toner is present and the toner unconsumed portion where toner remains coexist on the surface of the development roller 121 after the development roller has passed by the development zone. When such a development roller reaches the toner supply zone, toner is supplied by the electrostatic conveyance member. It is difficult to eliminate the difference between the toner consumed portion and the toner unconsumed portion. The recovery roller, remaining in contact with the development roller, is arranged downstream of the development zone and upstream of the toner supply zone along the direction of rotation of the development roller. The recovery roller recovers the unconsumed toner on the development roller. When the development roller reaches the toner supply zone, the toner supplying electric field formed in the toner supply zone moves the toner charged at the predetermined polarity from the electrostatic conveyance member to the surface of the development roller from which the residual toner has been recovered. This arrangement controls image faults such as density non-uniformities due to variations in the amount of toner sticking to the development roller subsequent to the passing of the development roller by the development zone and residual images.

The use of the electrically conductive recovery roller allows a bias voltage to be applied to the toner on the development roller, thereby increasing a toner recovery efficiency.

The toner charge amount changing unit may be arranged downstream of the development zone and upstream of the toner supply zone along the direction of rotation of the development roller. The toner charge amount changing unit changes the amount of charge of toner in the toner of the portions where the toner has been consumed with the toner thereof consumed in the development zone and the toner of the portions where the toner has not been consumed so that these toners are movable to the electrostatic conveyance member in the toner supply zone. Upon reaching the toner supply zone, the toner on the development roller with the amount of charge thereof changed moves to and is recovered to the electrostatic conveyance member. The toner supply electric field generated in the toner supply zone feeds the toner charged at the predetermined polarity from the electrostatic conveyance member to the surface of the development roller from where the residual toner has been recovered. This arrangement controls image faults such as the density non-uniformity and residual images due to the non-uniformity in the amount of toner sticking to the surface of the development roller, and residual images.

Since the spherical toner is used as a developer, the toner diameter becomes uniform, and a thin layer of toner having a uniform thickness is thus provided. The image quality is thus improved.

The toner in use preferably has a sphericity greater than 0.96 if measured using the flow-type particle image analyzer. Toner conveyance on the electrostatic conveyance member becomes stabilized if the sphericity of the toner in use is larger than 0.96. An image free from the pitch non-uniformity is thus obtained. With the toner sphericity smaller than 0.96, the contact surface of the electrostatic conveyance member is changed if the toner conveyance velocity increases. A difference occurs in non-electrostatic attractive forces, thereby making it difficult for the electrostatic conveyance member to convey the toner in a uniform fashion, and thereby leading to an image having toner non-uniformity.

Since the volume resistivity of the development roller is $10^6$ Ωcm or less, charge capacity is maintained for a long period of time.

To assure a sufficient amount of toner supply to the photoconductive drum from the development roller in a typical image processing apparatus, the linear velocity Vd of the development roller is typically set to be higher than the linear velocity Vp of the photoconductive drum. The ratio of the linear velocity Vp of the photoconductive drum to the linear velocity Vd of the development roller, Vd/Vp, alleviates the effect of toner non-uniformity due to the electrode pitch of the development roller on the image non-uniformity. The inventors of the present invention also have found that the human eyes are typically insensitive to the density non-uniformity equal to or smaller than 20 μm. When the movement of the photoconductive drum is aligned in the same direction as the movement of the development roller in the development zone, a relationship $P/\{(Vd/Vp)(Vs/Vd)\}<20$ μm holds where P represents the electrode pitch of the electrostatic conveyance member, Vs/Vd represents the ratio of the linear velocity Vd of the development roller to the toner conveyance velocity Vs along the electrostatic conveyance member, and Vd/Vp represents the ratio of the surface movement velocity Vp of the photoconductive drum to the linear velocity Vd of the development roller. This equation shows that the effect of the electrode pitch is thus alleviated by the ratio of the linear velocity Vd of the development roller to the toner conveyance velocity Vs along the electrostatic conveyance member and the ratio of the surface movement velocity Vp of the photoconductive drum 11 to the linear velocity Vd of the development roller, and that the image non-uniformity is reduced to 20 μm or smaller. This arrangement reduces the image non-uniformity due to the electrode pitch to a level that is almost invisible to the human eyes. The contact type development process in which the image is developed with the development roller and the photoconductive drum arranged in contact with the toner interposed therebetween is more subject to the non-uniformity in the thin layer of toner. With the difference set between the development roller velocity and the toner conveyance velocity on the electrostatic conveyance member, non-uniformity in the thin layer of toner on the development roller is improved. The arrangement is significantly useful in achieving high-quality images.

At least the photoconductive drum and the development unit may be integrated into a unitary body as a process cartridge, and the process cartridge may be detachably mounted into an image forming apparatus such as a copying apparatus or a printer. In the process cartridge, toner T scattered from the development roller is recovered by a photoconductive drum. Since the scattered toner is recovered into the process cartridge, the inside of the apparatus is free from the contamination of toner dirt.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. 2003-031176 filed on Feb. 7, 2003, No. 2003-047384 filed on Feb. 25, 2003, and No. 2004-013892 filed on Jan. 22, 2004 in the Japan Patent Office, the entire contents of which are incorporated by reference herein.

What is claimed is:

1. An image forming method, for forming an image by supplying a developer from a development unit to a latent image on a latent image carrying member, the method comprising:

forming a thin layer of developer on a developer carrying member by generating an electric field in a developer supply zone between the developer carrying member of the development unit and a developer conveyance member; and conveying the thin layer of developer formed on the developer carrying member to a development zone facing the latent image carrying member;

wherein the developer conveyance member conveys the developer using electrostatic effect to supply the developer to the developer carrying member;

wherein a relationship of $|Vs|>|Vd|$ holds where Vd represents a surface movement velocity of the developer carrying member, and Vs represents a developer conveyance velocity of the developer moving on the developer conveyance member.

2. An image forming method according to claim 1, wherein a protective layer made of a silicone-based resin is disposed on the surface of the developer conveyance member.

3. An image forming method according to claim 1, wherein a powder pump supplies the developer to the developer conveyance member from a developer container.

4. An image forming method for forming an image by supplying a developer from a development unit to a latent image on a latent image carrying member, the method comprising:

forming a thin layer of developer on a developer carrying member by generating an electric field in a developer supply zone between the developer carrying member of the development unit and a developer conveyance member; and conveying the thin layer of developer formed on the developer carrying member to a development zone facing the latent image carrying member;

wherein a developer charge amount changing means for changing an amount of electrical charge of the developer on the developer carrying member is arranged downstream of the development zone and upstream of the developer supply zone along the surface movement direction of the developer carrying member.

5. An image forming method for forming an image by supplying a developer from a development unit to a latent image on a latent image carrying member, the method comprising:

forming a thin layer of developer on a developer carrying member by generating an electric field in a developer supply zone between the developer carrying member of the development unit and a developer conveyance member; and conveying the thin layer of developer formed on the developer carrying member to a development zone facing the latent image carrying member;

wherein an electrically conductive member for applying a voltage to the developer on the developer carrying member is arranged downstream of the development zone and upstream of the developer supply zone along the surface movement direction of the developer carrying member.

6. An image forming method according to claim 5, wherein a toner having a spherical shape is used as the developer.

7. An image forming method according to claim 6, wherein the toner has a sphericity of 0.96 or larger.

8. An image forming method according to claim 5, wherein a relationship of $P/\{(Vd/Vp)(Vs/Vd)\}<20\ \mu m$ holds and a surface movement direction of the developer carrying member is aligned in the same direction as a surface movement direction of the latent image carrying member in the development zone, where P represents a pitch of electrodes in the developer conveyance member, Vs represents a developer conveyance velocity of the developer moved by the developer conveyance member, Vd represents a surface movement velocity of the developer carrying member, and Vp represents a surface movement velocity of the latent image carrying member.

9. An image forming apparatus for forming an image by supplying a developer from a development unit to a latent image on a latent image carrying member for image development, wherein the image forming apparatus forms the image using an image forming method according to one of claims 2,1,3, or 4–8.

10. An image forming apparatus according to claim 9, comprising a process cartridge having the development unit and the latent image carrying member integrated with the development unit in a unitary body, wherein the process cartridge is detachably mounted in the image forming apparatus.

11. A process cartridge integrating into a unitary body a latent image carrying member and at least a development unit for developing a developer image from a latent image on the latent image carrying member, wherein the process cartridge is detachably mounted in an image forming apparatus according to claim 9.

12. An image forming apparatus comprising:

a toner hopper;

a development roller;

a photoconductive drum;

an electrostatic latent image formed on the photoconductive drum;

an electrostatic conveyance member between said toner hopper and said development roller; and a supply roller configured to supply the toner from said toner hopper to the electrostatic conveyance member by a rotation, wherein said electrostatic conveyance member comprises a pattern of electrodes configured to set up an electric field along said electrostatic conveyance member, and wherein a toner forms a layer on a surface of the development roller, the toner is applied by an electrical field to the electrostatic latent image on the photoconductive drum, forming a toner image, and wherein the development roller and the photoconductive drum are separated by a gap.

13. An image forming apparatus according to claim 12, wherein said toner hopper comprises an agitator configured to agitate the toner and to move the toner to the supply roller.

14. An image forming apparatus according to claim 13, wherein said development roller is positioned close to an end of the electrostatic conveyance member and is separated from said electrostatic conveyance member by a supply gap so that said electrostatic conveyance member is not contacting the development roller.

15. An image forming apparatus according to claim 14, wherein an electrical field between the electrostatic conveyance member and the development roller is configured so as to cause the toner to jump from the electrostatic conveyance member onto the development roller over the supply gap.

16. An image forming apparatus according to claim 15, wherein said electrical field is generated by an AC voltage and a DC bias voltage.

17. An image forming apparatus according to claim 14, wherein said supply gap has a width between 0.1 mm and 0.6 mm.

18. An image forming apparatus according to claim 14, wherein said gap has a width in a range between 0.2 mm and 0.6 mm.

19. An image forming apparatus according to claim 12, further comprising:

a powder pump configured to fluidize the toner in the toner hopper by air.

20. An image forming apparatus according to claim 19, wherein said toner is conveyed by the powder pump through a conveyance tube to the supply roller and said toner is electrically charged by the powder pump.

21. An image forming apparatus according to claim 12, wherein said electrostatic conveyance member includes a silicone-based resin on an upper surface.

* * * * *